US008413561B2

(12) United States Patent
Thielges et al.

(10) Patent No.: US 8,413,561 B2
(45) Date of Patent: Apr. 9, 2013

(54) MULTIPLE PUNCH AND DIE ASSEMBLY

(75) Inventors: Bruce Thielges, Fridley, MN (US); Ron Windingstad, White Bear Township, MN (US); Larry Villeneuve, Zimmerman, MN (US); Phil Lysdahl, Nowthen, MN (US)

(73) Assignee: Mate Precision Tooling, Inc., Anoka, MN (US)

( * ) Notice: Subject to any disclaimer, the term of this patent is extended or adjusted under 35 U.S.C. 154(b) by 613 days.

(21) Appl. No.: 12/615,956

(22) Filed: Nov. 10, 2009

(65) Prior Publication Data

US 2011/0107888 A1 May 12, 2011

(51) Int. Cl.
*B21D 28/12* (2006.01)
*B21D 45/08* (2006.01)

(52) U.S. Cl. ..... 83/146; 83/552; 83/684; 83/698.91; 29/39

(58) Field of Classification Search ..... 83/684, 83/698.91, 618–620, 681, 111, 129, 144–148, 83/549–552, 686, 687, 690, 691; 72/446, 72/482.1–482.4, 442, 448; 483/28, 29; 29/35.5, 29/39, 43, 33 J See application file for complete search history.

(56) References Cited

U.S. PATENT DOCUMENTS

| | | | |
|---|---|---|---|
| 3,527,130 | A | 9/1970 | Knehans |
| 3,935,771 | A | 2/1976 | Cady, Jr. |
| 3,935,772 | A | 2/1976 | Demus et al. |
| 3,958,476 | A | 5/1976 | Bartha |
| 4,031,787 | A | 6/1977 | Cady |
| 4,092,888 | A | 6/1978 | Wilson |
| 4,141,264 | A | 2/1979 | Weisbeck |
| 4,248,111 | A | 2/1981 | Wilson et al. |
| 4,375,774 | A | 3/1983 | Wilson et al. |
| 4,440,052 | A | 4/1984 | Weisbeck |
| 4,446,767 | A | 5/1984 | Wilson |
| 4,516,450 | A | 5/1985 | Shuttleworth |

(Continued)

FOREIGN PATENT DOCUMENTS

| | | |
|---|---|---|
| DE | 3720777 | 1/1989 |
| DE | 3915489 | 5/1990 |

(Continued)

OTHER PUBLICATIONS

International PCT Search Report dated Feb. 21, 2008 for WO 2007/118146 published Oct. 18, 2007 (PCT/US2007/0066063 filed Apr. 5, 2007).

(Continued)

*Primary Examiner* — Phong Nguyen
(74) *Attorney, Agent, or Firm* — Dorsey & Whitney LLP; Stuart R. Hemphill

(57) ABSTRACT

A multiple punch and die assembly adapted to a punch press for carrying out a punching or forming operation comprises a punch assembly for holding a plurality of selectively operable punches that selectively engage a workpiece. The punch assembly has a punch carrier for reciprocal motion within a punch guide and a striker body engaging the punch carrier, said striker body being selectively, toollessly connectable to the punch carrier while permitting relative rotation of the striker body and punch carrier to select a punch for engagement by the striker. A detent means releasably positions the striker body in one of a plurality of operating positions, at which a punch is positioned for being struck selectively by the ram via the striker body such that one punch is driven to an operating position when at least one other punch is inactive, the inactive punches engageable by a lock plate.

27 Claims, 11 Drawing Sheets

U.S. PATENT DOCUMENTS

| | | | |
|---|---|---|---|
| 4,929,276 | A | 5/1990 | Chun et al. |
| 4,976,180 | A | 12/1990 | Otto |
| 4,977,804 | A | 12/1990 | Naito |
| 4,989,484 | A | 2/1991 | Johnson et al. |
| 5,042,352 | A | 8/1991 | Lux |
| 5,048,385 | A | 9/1991 | Eckert et al. |
| 5,054,347 | A | 10/1991 | Johnson et al. |
| 5,056,392 | A | 10/1991 | Johnson et al. |
| 5,062,337 | A | 11/1991 | Johnson et al. |
| 5,081,891 | A | 1/1992 | Johnson et al. |
| 5,119,666 | A | 6/1992 | Fujiwara |
| 5,131,303 | A | 7/1992 | Wilson et al. |
| 5,211,095 | A | 5/1993 | Chun et al. |
| 5,301,580 | A | 4/1994 | Rosene et al. |
| 5,329,835 | A | 7/1994 | Timp et al. |
| 5,382,102 | A | 1/1995 | Brolund et al. |
| 5,419,225 | A | 5/1995 | Fujita |
| 5,647,256 | A | 7/1997 | Schneider |
| 5,752,424 | A | 5/1998 | Rosene et al. |
| 5,813,301 | A | 9/1998 | Fujita |
| 5,832,798 | A | 11/1998 | Schneider et al. |
| 5,839,341 | A | 11/1998 | Johnson et al. |
| 5,848,563 | A | 12/1998 | Saito |
| 5,884,546 | A | 3/1999 | Johnson |
| 5,934,165 | A | 8/1999 | Chatham |
| 5,993,090 | A | 11/1999 | Straka et al. |
| 6,047,621 | A | 4/2000 | Dries et al. |
| 6,074,330 | A | 6/2000 | Ostini |
| 6,196,103 | B1 | 3/2001 | Schneider et al. |
| 6,276,247 | B1 | 8/2001 | Helda |
| 6,279,445 | B1 | 8/2001 | Rosene et al. |
| 6,334,381 | B1 | 1/2002 | Chatham |
| 6,675,688 | B2 | 1/2004 | Ostini |
| 6,755,110 | B2 | 6/2004 | Rosene et al. |
| 6,782,787 | B2 | 8/2004 | Morehead et al. |
| 6,895,797 | B2 | 5/2005 | Lowry et al. |
| 6,895,849 | B2 | 5/2005 | Rosene et al. |
| 7,032,812 | B2 | 4/2006 | Ostini |
| 7,168,356 | B2 | 1/2007 | Rosene et al. |
| 7,168,364 | B2 | 1/2007 | Schneider |
| D592,685 | S | 5/2009 | Ferry |
| 2007/0068352 | A1 | 3/2007 | Morgan |
| 2007/0261466 | A1 | 11/2007 | Lee et al. |
| 2008/0092711 | A1 | 4/2008 | Thielges et al. |
| 2008/0276783 | A1 | 11/2008 | Komiya |
| 2008/0314220 | A1 | 12/2008 | Ferry et al. |
| 2009/0078098 | A1 | 3/2009 | Lee et al. |

FOREIGN PATENT DOCUMENTS

| | | |
|---|---|---|
| DE | 44 11 121 C1 | 3/1995 |
| EP | 0556877 | 8/1993 |
| EP | 0579217 | 1/1994 |
| EP | 0674956 | 10/1995 |
| EP | 1334782 | 8/2003 |
| JP | 09108749 | 4/1997 |
| WO | WO 88/09232 | 12/1988 |
| WO | WO 2007/118146 | 10/2007 |

OTHER PUBLICATIONS

Finn-Power Multi Tool 24 Station 8mm Assembly, VFMVPC10_ 07096-01, Mate Precision Tooling, Apr. 8, 1997.

Finn-Power Multi Tool 24 Station 8mm Skid Plate, N0MY00PL, Mate Precision Tooling, May 12, 2000.

Strippit Multi-Tool 30 Station Short Tool Upper Assembly, VSMT104375, Mate Precision Tooling, Jun. 15, 2000.

Strippit Multi-Tool 30 Station Skid Plate, VST07, Mate Precision Tooling, Sep. 13, 2004.

Strippit Multi-Tool 8 Station Short Tool Metric Upper Assembly, VSMZ204375, Mate Precision Tooling, Feb. 8, 2001.

Strippit Multi-Tool 8 Station Skid Plate, VSM36, Mate Precision Tooling, Jun. 18, 1999.

Strippit Multi-Tool 3 Station 1-1/4 Inch Short Tool Upper Assembly, VSMS104375, Mate Precision Tooling, Apr. 17, 2001.

Strippit Multi-Tool 3 Station Skid Plate, VSMS07, Mate Precision Tooling, Jun. 18, 1999.

Strippit Multi Tool 8 Station Thin Turret Upper Assembly, MATE00096, Mate Precision Tooling, Jun. 18, 2001.

Xcel Multi Tool 8 Station Thin Turret Upper Assembly, MATE00641, Mate Precision Tooling, Aug. 17, 2005.

Strippit Multi Tool 8 Station Thick and Thin Turret Skid Plate, MATE00088, Mate Precision Tooling, Apr. 11, 2001.

Xcel Multi Tool 3 Station Thin Turret Upper Assembly, MATE00109, Mate Precision Tooling, Oct. 14, 2005.

Xcel Multi Tool 3 Station Thin Turret Skid Plate, MATE00106, Mate Precision Tooling, Dec. 28, 2004.

340
221
214
352
220
290
367
336
PP
330
232
231
210
210
221
310
360
301
351
308
290
302
307
303
304
221
135
314
366
367

MULTIPLE PUNCH AND DIE ASSEMBLY

TECHNICAL FIELD

The present disclosure relates to the punch and die art and more particularly to a multiple punch and die assembly adapted for use in a punch press for punching or forming sheet material.

BACKGROUND

In the fabrication of sheet metal and other workpieces, automated machinery may be employed, including turret presses and other industrial presses (such as single-station presses), Trumpf style machine tools and other rail-type systems, press brakes, sheet feed systems, coil feed systems, and many other types of fabrication equipment adapted for punching or pressing sheet materials. Sheet metal and other workpieces can be fabricated into a wide range of useful products, which commonly require various bends and/or holes to be formed in the workpieces. Turret presses have found wide use in punching and forming sheet metal and the like.

Turret presses typically have an upper turret that holds a series of punches at locations spaced circumferentially about its periphery, and a lower turret that holds a series of dies at locations spaced circumferentially about its periphery. Commonly, the press can be rotated about a vertical axis to bring a desired punch and die set into vertical alignment at a work station. By appropriately rotating the upper and lower turrets, an operator can bring a number of different punch and die sets sequentially into alignment at the work station in the process of performing a series of different pressing operations.

Multi-tools for turret presses allow a plurality of different tools to be available at a single tool-mount location on the press. Thus, in place of a tool with only one punch, there can be provided a multi-tool carrying a number of different punches. With such a multi-tool, any one of a plurality of punches carried by the multi-tool can be selected and moved to an operable position. When a multi-tool punch assembly is struck from above by the punch press ram, a single, selected punch element or punch insert within the assembly is driven downwardly through the workpiece to perform the punching operation, while the other punches (those not selected) remain inactive. When released, the punch insert is retracted by a spring or similar component provided in the multi-tool punch assembly.

Existing turret presses have dedicated multi-tool stations, but often they do not offer full indexability (punching at any angle relative to the workpiece) nor do they offer the flexibility of using the station as a single punch station. Many existing designs require a wrench or other tool to remove the upper portion of the multi-tool which slows set-up and repair operations by the operator. In addition, current multi-tool designs may mark workpieces by motion of non-selected punches or other multi-tool element and have stripper features that are not readily replaceable after wear or damage.

DESCRIPTION OF THE FIGURES

While the specification concludes with claims particularly pointing out and distinctly claiming the subject matter that is regarded as forming the various embodiments of the present disclosure, it is believed that the embodiments will be better understood from the following description taken in conjunction with the accompanying Figures, in which:

SUMMARY

Figure 1:
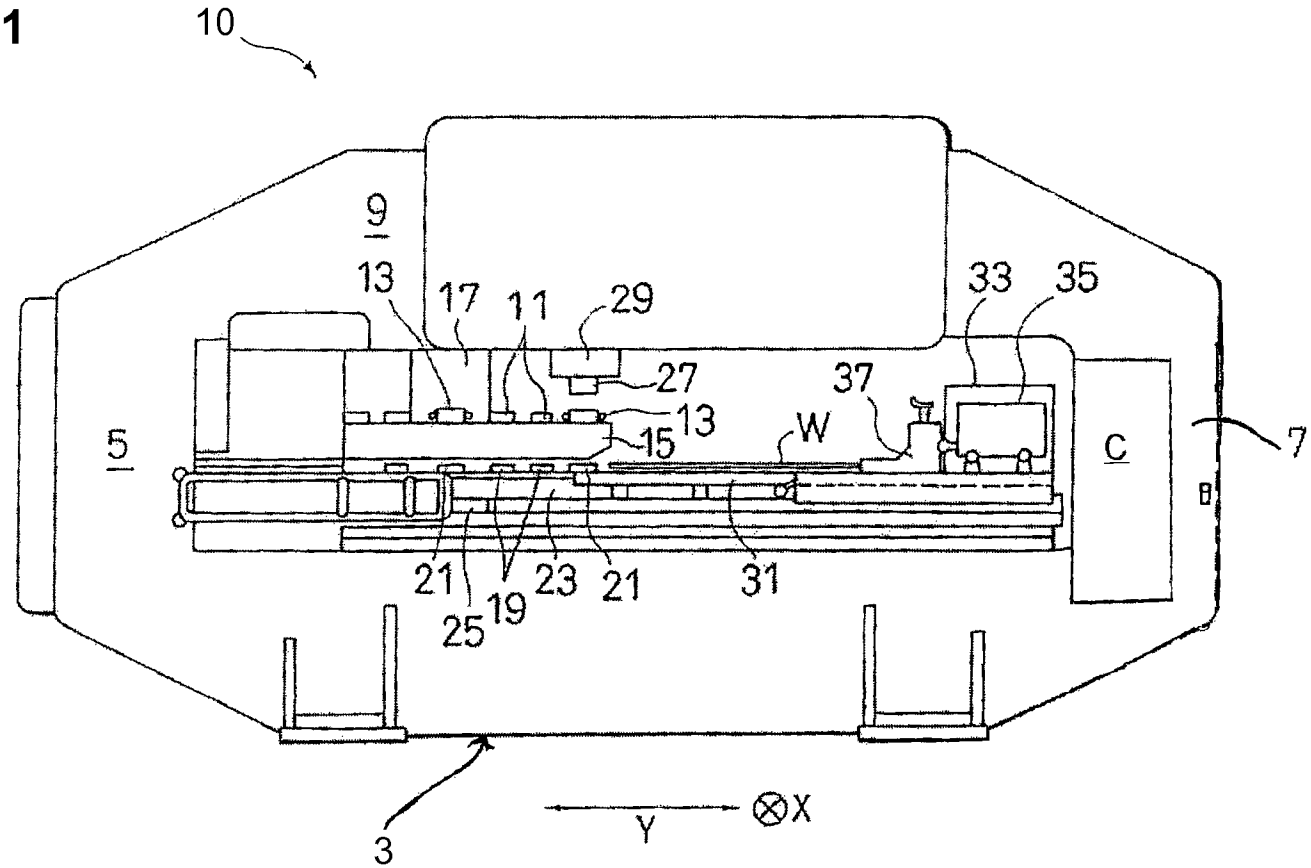
FIG. 1 depicts a prior art punch press machine assembly in which a fully-indexable multi-tool in accordance with the present disclosure may be used.

Accordingly, an object of the present disclosure is to provide an improved multi-tool assembly for use in a turret press. In one embodiment, described herein a multiple punch and die assembly adapted to be placed in a punch press having a punch ram for imparting movement to a selected punch assembly for carrying out a punching or forming operation comprises a punch assembly for holding a plurality of selectively operable punches mounted for independent movement in the punch assembly so as to selectively engage a workpiece. The punch assembly has a punch carrier for reciprocal motion within a punch guide and a striker body engaging the punch carrier, said striker body being selectively, toollessly connectable to the punch carrier by a pair of tabs located on a lower circumference of the striker body, said pair of tabs located on a lower circumference of the striker body with a radial separation other than 180 degrees. A circumferential lip in the punch carrier receives the pair of tabs and has corresponding radially separated reliefs for allowing the pair of tabs to pass the circumferential lip, the engagement of the pair of tabs by the circumferential lip thereby locking the striker body to the punch carrier while permitting relative rotation of the striker body and punch carrier to select a punch for engagement by the striker. A detent means releasably positions the striker body in one of a plurality of operating positions, at which a punch is positioned for being struck selectively by the ram via the striker body such that one punch is driven to an operating position when at least one other punch is in inactive.

In another embodiment the assembly has a punch lock plate mounted in the punch carrier and with a circumferential edge for engaging a stabilizing groove in each punch, said edge including a recess that releases a single punch from engagement when the recess is angularly aligned with such single punch, said punch lock plate being operably engaged to rotate with the striker body.

In another embodiment the assembly has a stripper retainer that has precision pockets for holding strippers corresponding to the selectively operable punches. A stripper retainer is mounted on the punch guide lower end for holding and precision positioning of two or more removable strippers, said punch guide having a cam structure for urging each of the removable strippers into a corresponding precision pocket in the stripper retainer that interlocks with the stripper to prevent stripper movement along the axis of punch motion and for releasing removable strippers from the pockets.

A further embodiment is a method for assembling a punch assembly comprising: attaching a striker body to the punch carrier, said striker body being selectively positionable by relative rotation of the striker body and punch carrier to select a punch for engagement by the striker, by positioning the striker body in one of a plurality of operating positions, at which a punch is positioned for being struck selectively by the ram via the striker body such that one punch is driven to an operating position when at least one other punch is inactive; mounting on the punch guide lower end a stripper retainer configured to hold and precision position two or more removable strippers, said stripper retainer having a cam structure for urging removable strippers into a corresponding precision pocket in the stripper retainer that interlocks with the removable strippers to prevent their movement along the axis of punch motion and for releasing the removable strippers from the pockets; and precision positioning two or more removable strippers in the stripper retainer by camming the cam structure such that the removable strippers are interlocked in a corresponding precision pocket within the stripper retainer.

A still further embodiment is a method for punch length adjustment comprising: providing at least one punch driver adjustably connected to a corresponding punch with a punch tip by means of threads on the male-female mating ends of the punch driver and the punch, said punch driver have a length adjustment reference edge and each of the punch driver and the punch having an alignment key to guide insertion into the punch assembly; providing on the exterior of the punch guide a flange and a length adjustment reference mark having a distance therebetween equal to the distance between (a) the length adjustment reference edge of a punch driver when the punch rests in a non-operating position and (b) the bottom surface of a corresponding stripper for the punch, less a small stripper lead, to define a reference length; resting the punch working tip on the flange and by relative rotation of the punch driver and punch, adjusting the at least one punch driver adjustably connected to a corresponding punch to have length corresponding to the reference length between the punch tip and the punch driver's length adjustment reference edge; and further adjusting the at least one punch driver adjustably connected to a corresponding punch by relative rotation of less than a full turn to bring into alignment the respective keys of the punch driver and punch.

DETAILED DESCRIPTION

Advantages over the Existing Art

The present disclosure is directed to a fully-indexable multi-tool for use with existing turret presses. The multi-tool disclosed herein may realize several advantages over existing multi-tools known to those skilled in the art. These advantages include, but are not limited to, the following: First, the multi-tool described herein may be designed so as to allow removal and insertion of punches without the use of tools. That is, the operator of the press may be able to remove the top cap (or striker body) of the multi-tool, and place or replace the punches contained within the multi-tool, without the need to use tools, for example, a wrench, or other implements, as existing multi-tools typically require. Tool-less changeablity may allow for faster interchange of punches, and therefore increased manufacturing productivity, which is an important consideration in fast-paced manufacturing operations.

Second, the multi-tool described herein may allow for the height of the punches within the multi-tool to be more adjustable. Over time, after prolonged use of a punch within a multi-tool, the punch point may become dull due to repeated contact with the workpiece. Repeated sharpening grinds away a portion of the punch point. Height adjustability of the punches may allow the operator to compensate for this observed "grinding down" effect over time, and further may allow for the punch point to be more easily sharpened by the operator, rather than having to replace the punch.

Third, the multi-tool described herein is designed for use within an existing auto-indexing single punch station of a turret press. That is, while many existing machines have dedicated multi-tool stations as well as auto-indexing single punch stations (allowing for the punch to strike the workpiece at any angle), many existing multi-tools may not be employed in a fully-indexable single punch station so as to realize the advantages of both the multiple punches within the multi-tool as well as the ability to provide the punch at any orientation relative to the workpiece.

Fourth, the multi-tool described herein is designed such that the strippers provided on the underside of the multi-tool may be removed without the use of tools or other implements, and further that the strippers are fully guided during the punching process. Existing design may either require the use of tools to remove guided strippers, or may use ball plungers to hold the strippers in place, which, although easily removed, may be subject to undesirable tangential movement during punching.

These and other advantages of the presently disclosed multi-tool may be understood from the detailed description set forth below. The above described advantages, therefore, are not intended to be limiting. The detailed description will first provide an overview of the use of the multi-tool within a typical turret punch press (though the press itself is not intended to form any part of the presently described multi-tool). Then, reference will be made to the features of the multi-tool that are designed to achieve the previously described advantages over existing multi-tools. References to certain components of the punch press machine may be made where appropriate, to describe interactions between the multi-tool and the punch machine.

Punch Press Machine Assembly

A multi-tool according to the present disclosure may be used in conjunction with existing fully-indexable turret presses (hereinafter referred to as "a machine" or "the machine"). Thus, there is no need to provide a specially designed turret machine in order to accommodate the multi-tool. Rather, operators should be able to simply insert the multi-tool into currently operating machines, with only minor modifications.

FIG. 1 shows a prior art turret punch press 10 as an example of a punch press on which embodiments of multi-tools according to the present invention may be mounted. This turret punch press 10 includes a base 3, two column frames 5 and 7 provided vertically on each side of the base 3, and an upper frame 9 provided to span between the column frames 5 and 7 above the punching workstation. A disk-shaped upper turret acts as upper tool holding body 15 supported by the upper frame 9 so as to be rotatable about an upper rotary shaft 17. In the same way, a lower, disk-shaped turret acts as lower die holding body 23 and is supported on the base 3 so as to be rotatable about a lower rotary shaft 25, typically in opposed, synchronized relationship with respect to the upper turret 15. Conventional punches 11 and multi-punch (multi-tool) assemblies 13 are removably attached to the upper turret 15, as upper tools.

Conventional dies 19 and die assemblies 21 are removably attached to the lower turret 23, as lower tools. A punch assembly 13 includes a plurality of small punches arranged circularly and a die assembly 21 includes a plurality of dies also arranged circularly according to the present invention, as described in detail hereinafter, which permits different punching functions to be selected at one angular position of the upper turret. The upper conventional punch 11 and the lower conventional die 19 form a pair of tools, and the punches of the punch assembly 13 and the dies of the die assembly 21 form a plurality of pairs of tools. A ram 29 having a striker 27 is supported on the upper frame 9 so as to be movable up and down to selectively strike the conventional punches 11 or the punch assembly 13. The upper turret 15 and the lower turret 23 are both controllably rotated by a turret servomotor (not shown) mounted on the frame. Thus a pair of any required conventional punch 11 and conventional die 19 or a pair of punch assembly 13 and die assembly 21 can be selectively moved to a punching position under the striker 27.

A fixed table (not shown) is provided at the middle upper portion of the base 3 in the X-axis direction, which is perpendicular to the sheet of the drawing of FIG. 1. A pair of movable tables 31 are supported on both sides of the fixed table in the X-axis direction. The pair of movable tables 31 are movable in the Y-axis direction (in a lateral direction in FIG. 1). A carriage base 33 is fixed to a movable table 31 in such a way as to straddle the fixed table. The carriage base 33 is provided with a carriage 35 so as to be movable in the X-axis direction. The carriage 35 is provided with a work clamp 37 for clamping an end of a plate-shaped workpiece W. A controller C which is programmable to position the workpiece, in particular to position it in coordination with any positioning motion of a punch or punch assembly that is to be applied, is in communication with motors or other actuators and positioning sensors (not shown). Thus the workpiece W can be located between the upper turret 15 and the lower turret 23 by moving the movable table 31 in the Y-axis direction and the carriage 35 in the X-axis direction.

The workpiece W located as described above can be punched by a pair of any required conventional punch 11 and die 19, or by a pair of punch and die in the punch and die assemblies 13 and 21, which are selectively located under the striker 27 by rotating the upper turret 15 and the lower turret 23 and by further positioning of a multiple punch assembly 21. In one embodiment, one punch in a multi-tool assembly is selected by rotating the assembly about a central axis to position a particular punch of the assembly under a ram that remains stationary in its angular orientation while the assembly rotates.

Depicted below the workpiece W is a die assembly 21 which may include a die carrier. The die carrier may support the work piece in position, and may be designed so as to be able to receive the punch tip and removed material upon punching. That is, the die carrier may have an equal number of individual dies as the multi-tool punch assembly 13 has punches, and in corresponding shapes, so that when a particular punch of the multi-tool penetrates the workpiece after being struck, the punch tip passes through the workpiece W and is received into the die of corresponding shape within the die carrier. The piece punched out of the workpiece W upon punching, known as the "slug," is also received at least initially into the respective die contained within the die carrier.

The present apparatus improves over prior art multi-tool designs by permitting not only selection of one multi-tool out of any assembly containing more than one but also by permitting the selected tool to be oriented at any angle for punching. When such a multi-tool assembly is used, it is mounted in an indexable turret so as to allow rotation of the multi-tool, or full indexability, relative to the work piece W. During operation, the press is provided operating instructions by control software, which may be stored and executed on computer hardware within the controller C at the machine, or may be stored and executed on a computer away from the machine in a control area, and in communication with the various positioning mechanisms of the machine 10. The software provides the press with instructions on, for example, how many punches to make on the workpiece W, which punch within the multi-tool to select and how to select and orient the multi-tool and the selected punch, motion of the workpiece to be coordinated with punch positioning and other control instructions known by those skilled in the conventional multi-tool art, for example, software provided by Striker Systems or NC Express Software, provided by Finn-Power.

Figure 2:
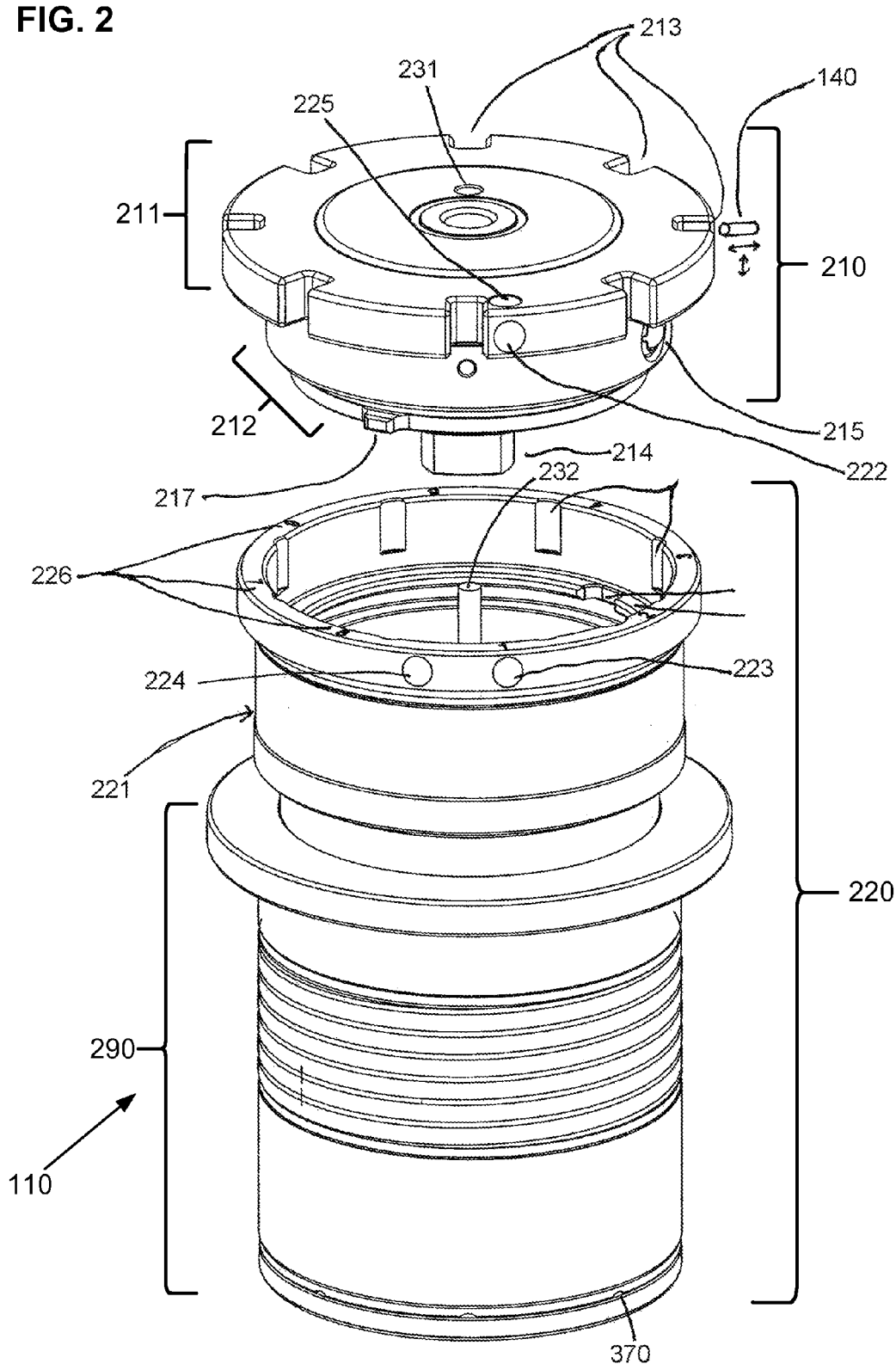
FIG. 2 is a pictorial view of an example multi-tool in accordance with the present disclosure, with the striker body separated from the punch assembly.

Not shown in FIG. 1 as part of the machine 10, but depicted in FIG. 2 is a selection pin 140. The pin 140 may be an existing part of a machine currently in operation, or it may be added to the machine to accommodate the operation of the presently described multi-tool. The pin 140 may be designed to engage the multi-tool so as to prevent rotational motion of the striker head and thus allow selection among the various punches within the multi-tool. The operation of the pin 140 in connection with multi-tool to achieve these functions will be described in more detail below with reference to the design of the multi-tool.

Multi-Tool Assembly

The characteristics of a multi-tool in accordance with the present disclosure will now be described. While certain features are depicted in the accompanying figures in certain configurations, those skilled in the art will realize that changes in the shape, orientation, and configuration of certain features may be made without departing from the scope of the present disclosure. Thus, obvious variants and equivalents of the multi-tool described herein are intended to be encompassed by the present disclosure and the accompanying claims.

With reference now to FIG. 2, depicted therein is a deconstructed view of a multi-tool 110 of in accordance with the present disclosure. The multi-tool 110 may include a striker body 210 and a punch carrier assembly 220, comprising punch carrier 221 within punch guide 290. The striker body 210 functions generally as an interface between the punching machine and the punches of multi-tool 110, such that when the ram 29 and striker 27 on the punching machine 10 (not shown in FIG. 2) strike the striker body 210, the force generated is transferred to a selected punch within the punch carrier assembly 220, causing the punch to move downwardly into the workpiece, as will be described more fully below.

As shown, the striker body 210 may be generally cylindrical in shape, with a wider diameter for the upper portion 211, which forms the top face of the multi-tool 110, and with a narrower diameter for the lower portion 212, which may be inserted within the interior of punch carrier 221. Positioned on the underside of lower portion 212 may be an internal ram 214 which is configured to strike a single punch within the multi-tool 110 when a ram 29 of a machine 10 (see FIG. 1) strikes the top of the striker body 210.

Punch Position Selection

In some embodiments, the periphery of the upper portion 211 of the striker body 210 may have a plurality of slots 213 which may be engaged by a pin 140 on the punch press machine 10 (not shown in FIG. 2). The slots 213 may be designed so as to receive the pin 140 of an indexable position of a turret machine. The pin 140 may be designed so as to be selectively insertable into the slots 213, approaching either laterally or vertically. When inserted and held immobile, the pin 140 aides selection from among the punches within the multi-tool. Specifically, when the pin 140 is inserted and held immobile, it prevents the striker body from rotating when an indexing means (not shown in FIG. 2; an example indexing means is depicted in U.S. Pat. No. 5,048,385, which is incorporate by reference) rotates the punch carrier assembly 220. When the punch carrier assembly 220 rotates relative to the striker body 210, the ram 214 thereby is positioned above one of the punches (not shown in FIG. 2) contained within the punch carrier assembly 220. That is, as the punch carrier assembly 220 rotates when indexed, this rotation in turn causes a different one of the punches within the carrier to be positioned beneath the ram 214, which itself remains stationary as the striker body 210 is restrained from rotation by means of the pin 140 being inserted into one of the slots 213.

Thus, by indexing the punch carrier assembly 220 with the pin 140 inserted into one of the slots 213, the operator may select from among the various punches of the multi-tool 110. Once the desired punch is reached, the indexing mechanism stops, the pin 140 is retracted, and the multi-tool 110 is then ready to rotate (index) to any angle setting the operator desires of that now-selected punch.

Indexing after Punch Selection

The angular orientation at which the selected punch strikes the workpiece may also be accomplished by the indexing mechanism of the machine 10. In this case, however, the pin 140 is not inserted in the striker body when the indexing occurs. Thus, when indexing motion is now applied, both the striker body 210 and the punch carrier assembly 220 rotate in unison, causing the orientation and position of the punch to be changed relative to the workpiece below, while maintaining the ram 214 above the same punch. As the indexing may occur at a rapid angular speed, a ball plunger 215 may be provided along the outer diameter of the lower portion 212 of the striker body 210. The ball plunger 215 may be designed so as to engage with one of several half-moon shaped vertical slots 216, positioned along the inner diameter of the upper portion of the punch carrier 221 and corresponding to a punch location. Thus, when the punch carrier assembly 220 is rotated relative to the striker body 210 when selecting a respective punch (with the pin 140 inserted), the ball plunger 215 is thereby caused to be positioned adjacent a respective vertical slot 216. When rotation stops, the ball plunger 215 will engage the respective slot 216. This engagement thereby prevents the striker body 210 from "slipping" due to the rotational force applied when the punch carrier assembly 220 is indexed without pin 140 being inserted into one of the slots 213. Thus, the striker body 210 and the punch carrier assembly 220 may rotate in unison, maintaining the ram 214 above the selected punch and moving the selected punch in a circle, in which it achieves all possible angular orientations. The ball plunger 215 may comprise a ball and spring assembly. Selection of the relative size of the ball and strength of the spring may determine the strength of the engagement of the ball plunger 215 with the vertical slot 216; i.e., a larger ball and stronger spring result in stronger engagement. In some embodiments, the size of the ball is larger (on the order of ten to fifteen degrees of arc, as compared with less than five degrees in the prior art) and the force of the spring may be selected so as to permit rotation of the striker body 210 manually by the operator, while still maintaining a strong enough engagement with the slots 216 to resist the torquing forces imparted by the indexing means of the machine. In alternative embodiments, half moon shaped vertical slots may be provided along the outer diameter of the lower portion 212 of the striker body 210, while the ball plunger 215 may be provided along the inner diameter of the upper portion of the punch carrier 221 (thus reversing the depicted configuration). Furthermore, slot shapes other than half moon may also be used in any of the above described embodiments. The resulting ball plunger arrangement is sufficient to provide holding that is not over come by multi-tool indexing but can be overcome when an operator does hand rotation for punch selection.

Punch Interchangeability

With continued reference to FIG. 2, as previously mentioned, one advantage of the presently disclosed multi-tool 110 is that the punches may be interchanged quickly without the needs for tools, e.g., a wrench. Removing the punches from within the punch carrier assembly 220 requires that the striker body 210 be separated from the punch carrier 221 (as depicted in FIG. 2). And, before the multi-tool 110 is placed back in the machine 100, the striker body 210 must be reconnected with the punch carrier 221 to be operable. The speed and ease with which an operator performs this separation/connection of the striker body 210 and the punch carrier 221 is an important consideration in the speed at which punches may be interchanged, and thus the efficiency of the punching operation.

In order to provide a tool-less removal and insertion of punches, two or more tabs 217 may be provided along the circumference of the lower portion 212 of the striker body 210. These tabs 217 may be designed so as to fit into, and pass through, an equal number of reliefs 218 cut out of the upper side of a circumferential channel or single lip 219 provided along the inner circumference of the punch carrier 221. In order to insert the striker body 210 into the punch carrier 221, the tabs 217 are manually aligned with the reliefs 218, and then striker body 210 is caused to be inserted into the punch carrier 221. Once fully inserted, the tabs 217 pass through the reliefs 218 to a position within the circumferential channel or single lip 219. The striker body 210 may then be rotated to a "home" position (discussed in more detail below), such that the tabs 217 are positioned within, and restrained by, the walls of the circumferential channel or single lip 219 in which the tabs 217 rest. In alternative embodiments, a circumferential channel or single lip 219 may be provided along the circumference of the lower portion 212 or the striker body 210, and the tabs may be provided along the inner circumference of the punch carrier 221 (thus reversing the depicted configuration). This provides an equivalent structure permitting tool-less access to the punches.

To ensure a known and determined orientation of the striker body 210 and the punch carrier 221 after their joining, the tabs 217 and corresponding reliefs 218 are positioned so that only one orientation for insertion is possible. In particular, the tabs 217 are not in symmetrical and opposed positions along the circumference of the lower portion 212 of the striker body 210; i.e., if a pair of tabs and corresponding reliefs are used, they are not separated one-hundred and eighty degrees from each other, but rather at, for example one-hundred seventy degrees of separation along one arc and one-hundred ninety along the opposed arc. If a set of four tabs and corresponding reliefs were used, they are not separated by ninety degrees from each other or in any other pattern symmetrical around two orthogonal planes, but rather with the opposed arcs being unequal in size. The unequal arcs ensure matching of tabs 217 and reliefs 218 in only a single relative orientation of the striker body 210 and the punch carrier 221.

In order to remove the striker body 210 from the punch carrier 221, the opposite procedure may be performed. The striker body 210 may be rotated out of the "home" position and rotated such that the tabs 217 become aligned with and below the reliefs 218. Thus, not restrained by the circumferential channel or single lip 219, the striker body 210 may be lifted, and the tabs 217 pass upwardly through the reliefs 218, until the striker body 210 is fully removed from the punch carrier 221.

In order to assist the operator in aligning the tabs 217 with the reliefs 218 and/or the "home" position, indicators 222-224 may be provided at selected positions on the exterior circumference of the striker body 210 and the punch carrier 221. Aligning the indicator 222 (on the striker body) and indicator 224 (on the punch carrier 221) indicates that the tabs 217 are aligned with the reliefs 218, thus indicating that the striker body 210 may be inserted into, or removed from, the punch carrier 221. Furthermore, once the striker body 210 has been inserted into the punch carrier assembly 220, rotating the indicator 222 (on the striker body) to align with the indicator 223 (on the punch carrier 221) indicates that the "home" position has been reached (the striker body 210 is positioned to select punch position "1", assuming the positions are consecutively numbered, starting with "1").

In further aid to the operator, a window 225 may be provided on the striker body 210 to allow the operator to view a position or punch selection indicator, such as a number 226, marked on the upper rim of punch carrier 221. There are multiple indicators (i.e., such as consecutive numbers or letters) on the rim, and the presence of one indicator in the window 225 shows the punch selected. As previously discussed, the indexing function, in connection with the pin 140 being inserted into one of the slots 213 along the periphery of the upper portion 211 of the striker body 210, allows a punch to be selected by rotating the punch carrier assembly 220 relative to the striker body 210. However, because the ram 214 will not be visible to the operator when the multi-tool 110 is assembled, it may be beneficial to provide a means to allow the operator to visually determine which punch has been selected (i.e., the punch over which the ram 214 has been positioned). The window 225 may therefore allow the operator to view a number (or other indicator) 226 inscribed along the upper rim of the punch carrier assembly 220 when the multi-tool 110 is fully assembled. That is, the window 225 aligns with a respective number 226 when the ram is positioned above that respective punch, allowing the operator to view only that respective number 226. Furthermore, the multi-tool 110 may be manually set by the operator to a particular punch position using the window 225 so as to set the multi-tool 110 to the punch position at which it was previously removed from the machine, which may eliminate the need to reset the software, or other computer application, to the home position upon replacing the multi-tool 110 within the machine for operation.

Punch Configuration

Figures 3A, 3B:
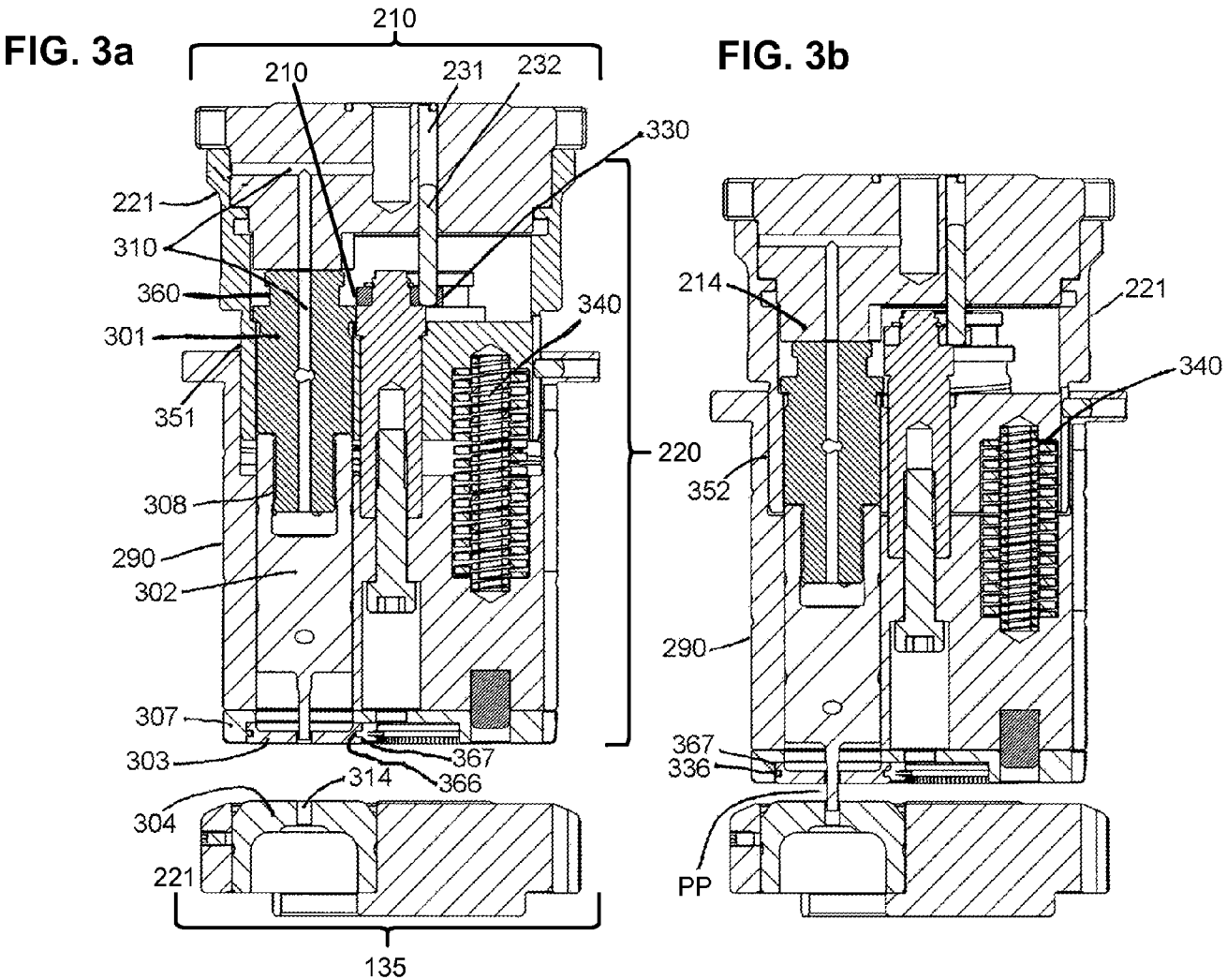
FIG. 3*a* is a cross-sectional view of an example three-punch multi-tool in accordance with the present disclosure.
FIG. 3*b* depicts the multi-tool of FIG. 3*a* in a punching position.
Figures 3C, 3D:
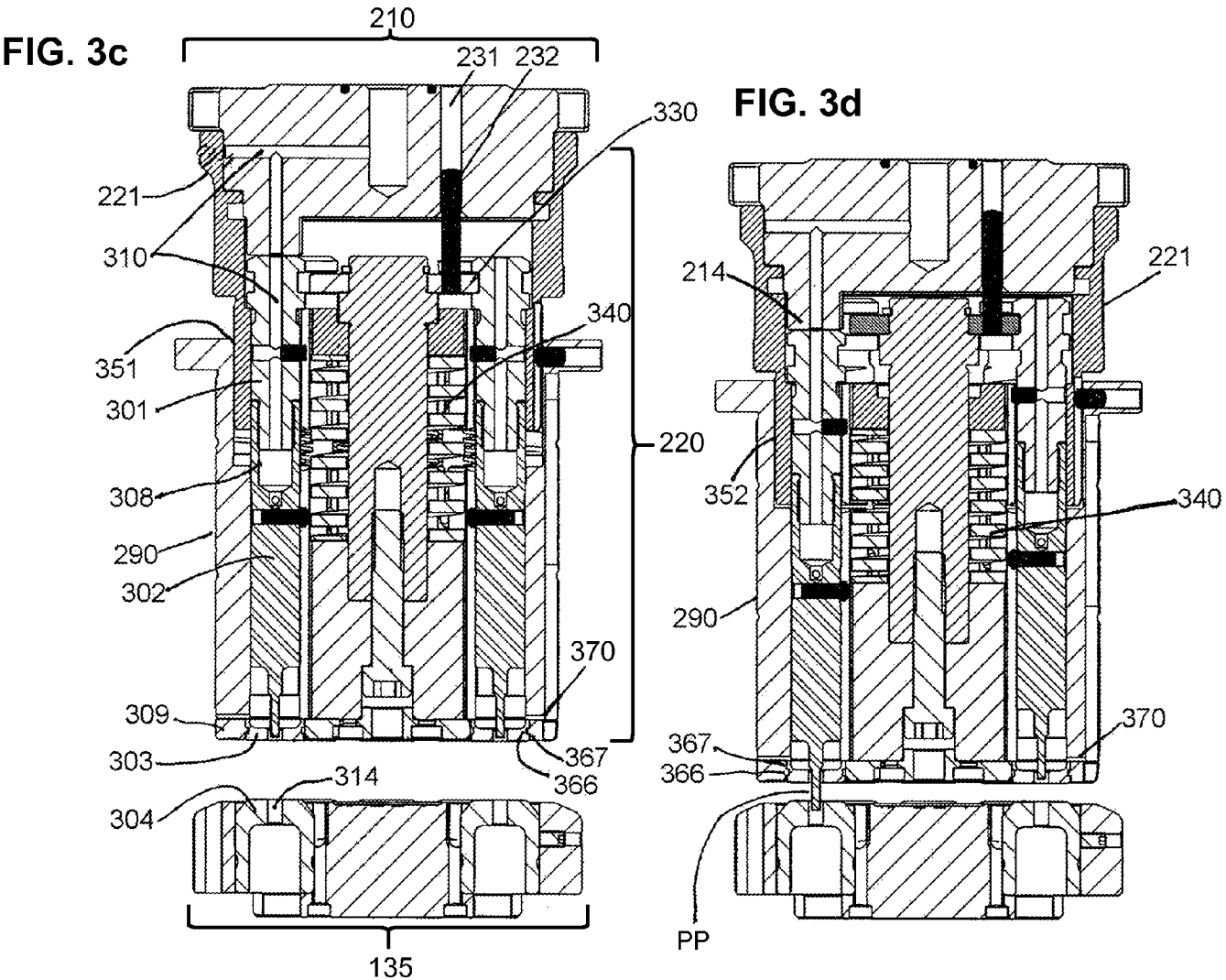
FIG. 3*c* is a cross-sectional view of an example eight-punch multi-tool in accordance with the present disclosure.
FIG. 3*d* depicts the multi-tool of FIG. 3*c* with one punch in a punching position.
Figure 3E:
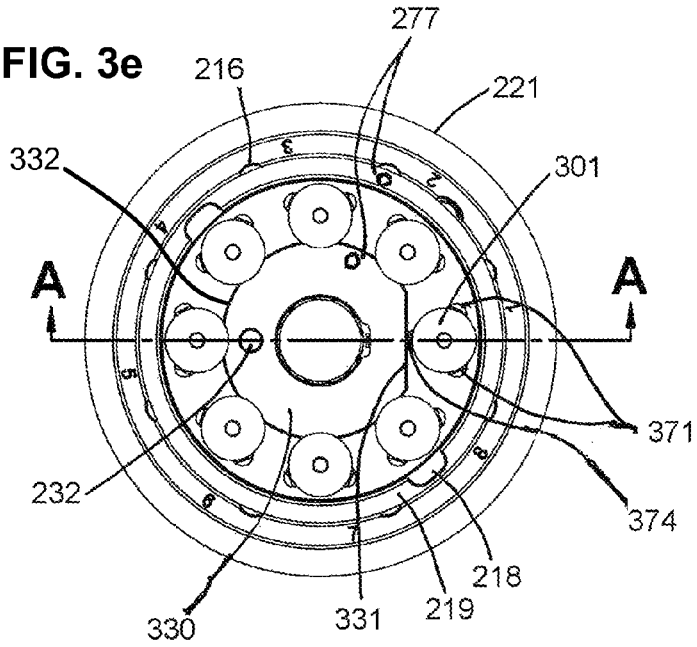
FIG. 3*e* is a top view of an example eight punch multi-tool in accordance with the present disclosure, with the striker body removed.

With reference now to FIG. 3, the internal components of the punch carrier assembly 220 are depicted. In particular, FIGS. 3*a* and 3*b* depict a multi-tool with three punch stations, while FIGS. 3*c*, 3*d* and 3*e* depict a multi-tool with eight punch stations. Further, FIGS. 3*a* and 3*c* depict a respective three and eight punch multi-tool which is in a retracted (or "non-punching" position), while FIGS. 3*b* and 3*d* depict a respective three and eight punch multi-tool which is in a struck (or "punching") position. Any arrangement of two or more punch stations is possible.

With particular reference now to FIGS. 3*a* and 3*c*, the internal components of striker body 210, punch carrier assembly 220, and die carrier 135 are presented. The die carrier 135 may contain two or more dies 304, for example, three or eight dies 304 as depicted in FIGS. 3*a* and 3*c*, respectively, each of which has an aperture 314 for receiving the tip of a corresponding punch 302. As previously mentioned, the apertures 314 in the dies 304 are shaped to correspond to the shape of the respective punch 302, but are slightly larger to allow the slug and die tip to fit therewithin, and be removed from the aperture 314 once punch action is complete. At FIGS. 3*b* and 3*d*, reference PP depicts the punching position, wherein the tip of the punch 302 has been caused to be inserted within the aperture 314 of the die 304.

With continued reference now to FIGS. 3*a* and 3*c*, the striker body 210 is depicted having the ram 214 positioned directly above a punch driver 301. In total the multi-tool depicted in FIG. 3*a* may have three punch drivers, while the multi-tool depicted in FIG. 3*c*, may have eight punch drivers. The remainder of the punch drivers (those not being below the ram 214, or the "inactive" punch drivers) are not shown in the cross-section. The punch drivers 301 in each multi-tool are identical in structure, and are designed to be fitted with the differing punches 302 which may be desired to be used.

Punch Length Adjustment

A punch driver 301 may be connected to the corresponding punch 302 by means of threads 308 on the male-female mating ends of the punch driver 301 and the punch 302. Threading the punch driver 301 and the punch 302 together a greater or lesser amount (i.e., number of rotations) determines the length of the punch/punch driver combination, and thus determines the depth at which the punch is driven through the workpiece. As previously discussed, an advantage of the presently disclosed multi-tool is that the length of the punches may be more accurately determined to allow the operator more refined control of an individual punch's punching characteristics. Existing multi-tools may only allow the length of the punch to be determined by a full rotation of the punch driver 301 relative to the punch 302 along the threading 308. That is, a full rotation must be provided to maintain the angular orientation of the punch 302 key relative to the punch driver key so that the two may be inserted into the punch carrier assembly 220. Because a full rotation is required, the increments of length adjustment available may be larger than desired.

Figure 4:
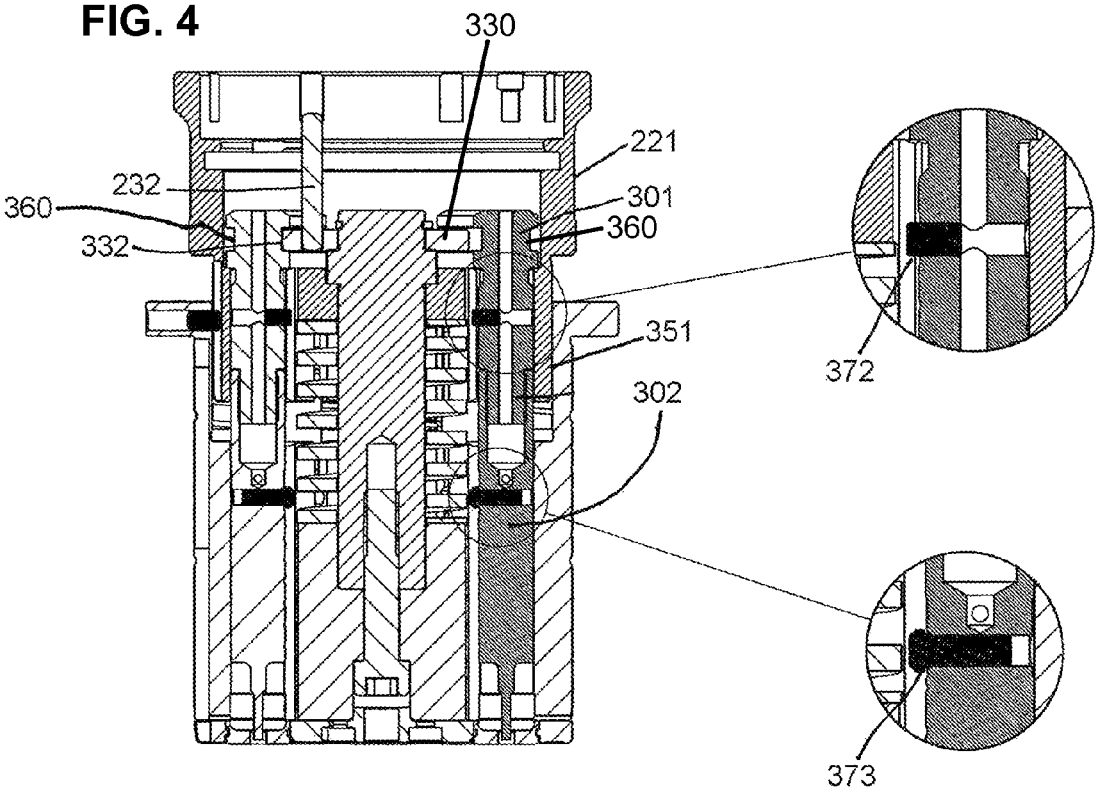
FIG. 4 is a cross-sectional view (at line A-A of FIG. 3*e*) of an example multi-tool with particular detail views showing punch length adjustability components.

In order to overcome this problem, the multi-tool of the present disclosure allows for the punch length to be adjusted at only a ⅓ rotation of the punch driver 301 relative to the punch 302 along the thread 308. With reference now to FIGS. 3*e* and 4, a key 373 on the punch 302 fits into a vertical slot 374 (depicted in a view looking down into the punch carrier 221) in each punch station of the punch carrier 221 (a punch carrier configured with eight punch positions to hold eight punches is depicted in FIGS. 3*e* and 4). During installation of the punch 302, the punch key 373 must pass through the slot 374 in the punch carrier 221. The slot 374 at each punch position extends the full vertical length of the punch carrier assembly 220. Thus, in order for the punch 302 to be fully inserted into its position in the punch carrier assembly 220, the punch key 373 must be aligned with the slot 374. The punch key 373 being within the slot 374 prevents the punch 302 from rotating. (For still further adjustment it will be seen that three, four, or more additional slots may be provided.)

Two additional slots 371 may be provided at each punch position within the punch carrier 221. These other two slots 371, which are preferably at equal spacing from the slot 374, only allow a punch driver key 372 to pass therein. The slots 371 do not extend the full vertical length of the punch carrier assembly 220—only a length sufficient to allow the punch driver 301 to be fully inserted. The punch driver key 372 may also pass into the slot 374.

Thus, in order to adjust the length of the punch/punch driver, the punch driver 301 is extracted out of the punch position just enough so that the punch driver key 372 is free from the slot 371 or 374 (whichever it had been inserted into). The punch driver 301 may then be rotated in place to align the punch driver key 372 with an adjacent slot 371 or 374 (a ⅓ rotation along the thread 308). Because the punch driver 301 has only been extracted enough to allow the punch driver key 372 to clear the slot 371 or 374, the punch 302 is itself still in the interior of the punch carrier 221 in its respective position, and the punch key 373 is still in the slot 374. Thus, as the punch driver 301 is rotated, the punch 302 remains stationary, causing the punch driver 301 to be rotated relative to the punch 302 along the thread 308, and thereby causing the length of the punch/punch driver to be longer or shorter, depending on the direction of rotation, in increments of ⅓ rotation. Such adjustment may be useful to adjust punching depth or to compensate for loss of punch length during sharpening or refurbishing.

Figure 8:
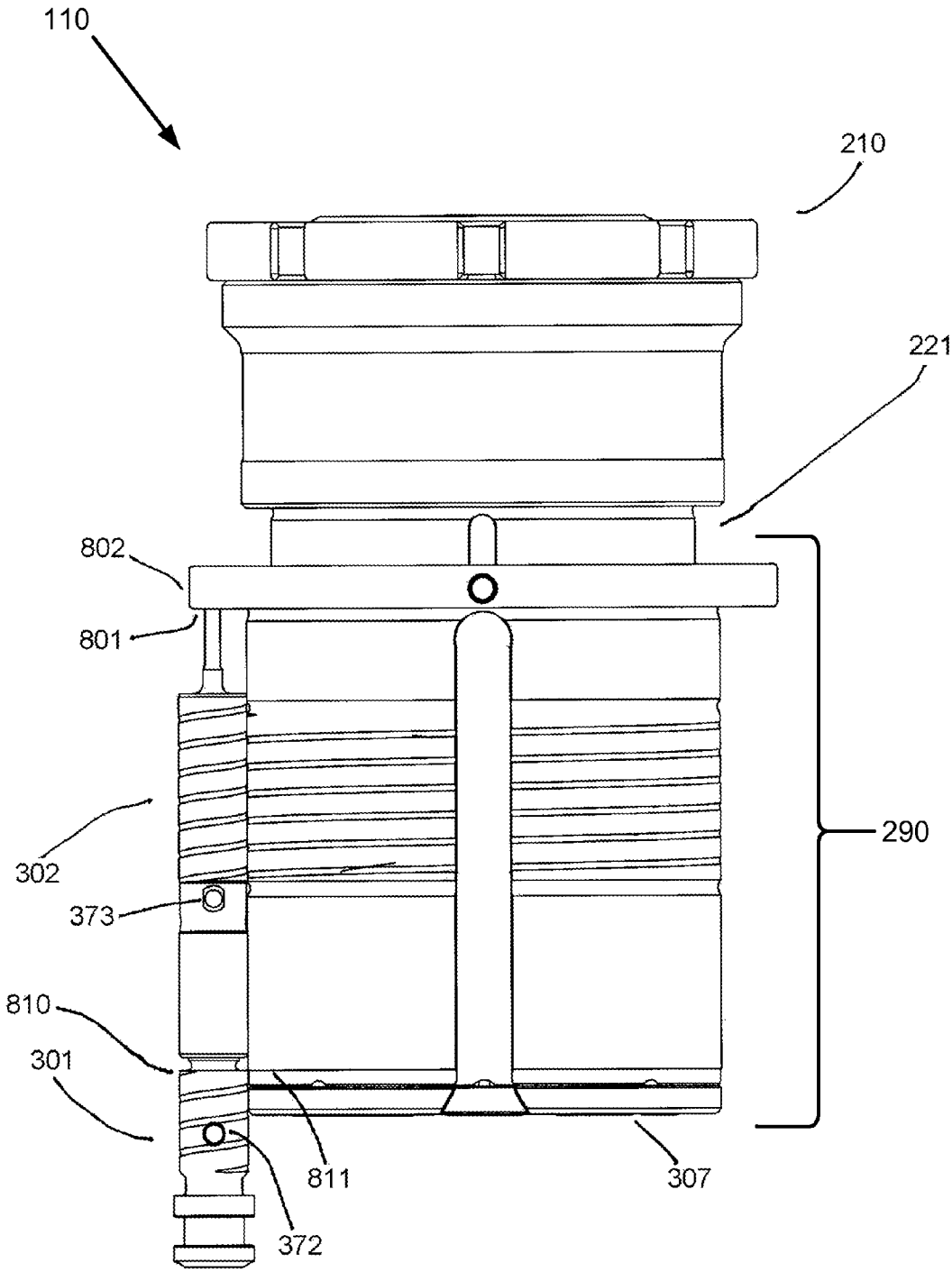
FIG. 8 is a pictorial view of an example multi-tool in accordance with the present disclosure, with a punch and punch driver removed from the punch assembly for adjustment.

In another adjustment procedure designed to aid an operator, with particular reference to FIG. 8, an operator may align a punch tip 801 with a flange 802 of the punch guide 290. The punch driver 301 may then be rotated within the punch 302 until a reference edge 810 or mark of the punch driver 301 is aligned with a reference edge 811 or mark on the punch guide 290. The edge/mark 811 may be positioned on the punch guide 290 so as to define a length for the punch carrier 221, such that when a properly adjusted punch with that length is inserted in the punch carrier 221, the punch will have the desired location of the punch tip relative to the stripper. (Typically, the punch tip of a properly adjusted punch resting in a non-operating position will be recessed from the bottom (or workpiece contacting) surface of its corresponding stripper by a small distance that may be called a "stripper lead".) In alternative embodiments, a line inscribed on the exterior of the punch guide 290 may be used in place of an edge or single mark. Once the approximate desired punch length is determined by use of this built-in reference length, the keys 372, 373 may then be aligned by rotating the punch driver 301 in either direction (preferably, in whichever direction would result in the smallest rotation for alignment of the keys 372, 373). That is, the operator performs a step of further adjusting the punch length as measured against the punch guide 290 by performing a relative rotation that brings into alignment the respective keys of the punch driver and punch with a rotation direction that uses the shortest arc of relative rotation to achieve such alignment. The procedure allows the combined punch 302 and punch driver 301 of desired length now to be inserted within the punch carrier 221 with no separate measuring tool needed.

In sum, the process of punch length adjustment using this feature involves: providing at least one punch driver adjustably connected to a corresponding punch with a punch tip by means of threads on the male-female mating ends of the punch driver and the punch, said punch driver have a length adjustment reference edge and each of the punch driver and the punch having an alignment key to guide insertion into the punch assembly; providing on the exterior of the punch guide 290 a flange and a length adjustment reference mark having a distance therebetween equal to the distance between (a) the length adjustment reference edge of a punch driver when the punch rests in a non-operating position and (b) the bottom surface of a corresponding stripper for the punch, less a small stripper lead, to define a reference length; resting the punch working tip on the flange and by relative rotation of the punch driver and punch, adjusting at least one punch driver adjustably connected to a corresponding punch to have length corresponding to the reference length between the punch tip and the punch driver's length adjustment reference edge; and further adjusting the at least one punch driver adjustably connected to a corresponding punch by relative rotation of less than a full turn to bring into alignment the respective keys of the punch driver and punch.

Workpiece Marking

With continued reference to FIG. 4, an additional problem which has been observed in existing multi-tools is the tendency of inactive punching stations to move downward and "mark" the workpiece when the active punch is driven through the workpiece. That is, when the machine ram 29 strikes the striker body 210, thus causing the ram 214 to strike the punch driver 301 therebelow (the "active" punch), the ram's downward force may also cause the inactive punches to move downward and briefly strike, or "mark" the workpiece, especially when the workpiece is a soft metal which marks easily. In existing multi-tools, the inactive punches may be caused to mark the workpiece because there is no (or insufficient) vertical retention of the inactive punches to prevent the nearby force of the ram striking action to cause them to move downwardly.

Thus, in the multi-tool of the present disclosure, as best seen in FIG. 3*e*, there may be provided a punch lock plate 330 within the punch carrier 221 (punch lock plate 330 is also shown at a side view in FIGS. 3*a* and 3*c*). The punch lock plate 330 may be a generally circular or curved plate, but having one recessed edge 331. The recessed edge 331 may be of any shape, for example, flat, as shown. The punch lock plate 330 may be positioned generally centrally within the punch carrier 221, and generally within the circumference defined by the various punch drivers 301 (eight of which are shown in FIG. 3*e*). As depicted in FIGS. 3*a*, 3*c*, and 3*e*, each punch driver 301 may have a circumferential recess near its top, forming a notch 360 around the circumference. The punch lock plate 330 is positioned to engage these notches 360 along the length of its generally curved circumferential edge 332. This engagement prevents the punch drivers 301 (as well as the punches 302 connected thereto) from moving either upward or downward in the vertical direction. The recessed edge 331 of the punch lock plate 330 does not extend outwardly enough from the center axis of the punch carrier 221 to engage the punch driver 301 to which it is adjacent, as shown in FIG. 3*e*. The recessed edge 331 may be designed to be of a length such that only one punch driver 301 (and its notch 360) may be disengaged from the punch lock plate 330 at any given time. This disengaged punch driver 301 may be referred to as the active position, whereas engaged punch drivers 301 may be referred to as inactive positions.

In order for the active position to punch the workpiece, the ram 214 (FIG. 2) is positioned directly above the active position punch driver 301. As previously discussed, position selection is accomplished by means of rotating the punch carrier assembly 220 relative to the striker body 210. Thus, in order for the ram 214 to always be positioned above the punch driver 301 which is disengaged from the punch lock plate 330, the punch lock plate may be mechanically coupled to the striker body 210. Such coupling, in one embodiment, may be accomplished by means of a vertically extending pin 232 on the punch lock plate 330 which fits into a hole 231 in the striker body 210 (also shown in FIGS. 2, 3*a*, and 3*c*). When connecting the striker body 210 to the punch carrier 221, the operator may align the vertical pin 232 of the punch lock plate 330 with the hole 231 in the striker body 210 such that the pin 232 is mechanically coupled to the striker body 210 by being inserted within the hole 231. Thus, the striker body 210 and the punch lock plate 330 may rotate in unison such that the ram 214 is always positioned above the active punch driver 301. Additionally, a dimple or other marking 277 (shown in FIG. 3*e*) may be added to the punch lock plate 330 and to the punch carrier 221 to be aligned when the operator is installing the striker body 210. Dimple alignment would thus cause the pin 232 to automatically align with the hole 231 during assembly.

Stripping Springs

With continued reference now to FIGS. 3*a* and 3*c*, a multi-tool 110 in accordance with the present disclosure may be provided with one or more coil stripping springs 340 positioned between the punch carrier 221 and a punch guide 290. In alternative embodiments, other resilient members, for example gas springs, urethane elements, etc., may be used in place of coil stripping springs 340. The punch guide 290 may be of a cylindrical shape so as to enclose the lower portion of the punch carrier 221 therewithin and allow telescoping of the punch carrier 221 into the punch guide 290. The punch guide 290 may guide the motion of the punch carrier 221 and punches 302 in the vertical direction during punching operations. Reference numeral 351 in FIGS. 3*a* and 3*c* shows the position of the punch carrier 221 relative to the punch guide 290 when not punching, while reference numeral 352 in FIGS. 3*b* and 3*d* shows the position of the punch carrier assembly 220 relative to the punch guide 290 during punching.

The stripping springs 340 are compressed during punching, and once the punching force is withdrawn (i.e., the striker 27 and ram 29 disengage from the striker body 210) the stripping springs 340 may provide a retracting force to reverse the telescoping of the punch carrier 221 into the punch guide 290. Stripping springs 340 thereby retract the active punch 302 out of the workpiece after punching a hole. There may be a significant amount of pressure around the punch point 330 that has gone through the workpiece, which may require some force to retract the punch 302 out of the workpiece.

Stripping springs 340 may be provided at various locations around the circumference of the punch carrier assembly 220. Each location may have one or more stripping springs 340 positioned vertically on top of one another. The more (or stronger they are) springs provided, the greater the retraction force may be, which may be necessary for thicker workpiece materials. However, stronger stripping spring force means the striker must deliver more compression for punching. This may also result in greater force being transferred to the punch guide 290, which may result in undesirable workpiece marking. In some embodiments, stripping springs 340 may be designed so as to be removable to adjust the amount of force provided by the springs. Alternatively, replacement springs of different strength (spring constant) may be provided. Adding or removing stripping springs 340 symmetrically around the circumference of the punch carrier assembly 220, or providing springs with a lower constant, may thus help prevent marking, depending on the thickness or softness of the workpiece. With thinner or softer workpiece materials, removable/replaceable springs 340 allow the operator to reduce the compression/retraction forces acting upon the multi-tool 110, and thus may also prevent marking from occurring in such materials.

The stripping spring force adjustment method thus comprises adjusting a stripping force applied to the punch carrier assembly 220 either by selectively removing in a generally symmetrical manner relative to a central axis of the punch guide 290 two or more springs compressed when the striker body drives a punch into a workpiece or by replacing in a generally symmetrical force pattern relative to a central axis of the punch guide 290 two or more such springs with springs of a selected different spring constant.

Stripper Retention System

Again referring to FIGS. 3*a* and 3*c*, the multi-tool of the present disclosure may be provided with a stripper retainer 307 on the underside of the punch carrier assembly 220 (adjacent to and facing the workpiece) and a number of strippers 303 contained in the carrier 307 corresponding to the number of punches 302 (three in FIG. 3*a*, and eight in FIG. 3*c*). As will be known to those skilled in the art, the strippers of a multi-tool may remove or "strip" the workpiece off of the punch 302 during operation of the punch. The stripper retainer 307 may function to hold the individual strippers securely in place. While in some applications a loose fitting stripper is acceptable, in other applications full guiding with precision fit strippers is desired, as will be known to those skilled in the art. Because of the build-up of tolerances in a tool, a stripper arrangement that allows increase precision is desirable. For example, precision strippers may have diameter tolerances of 0.0002-0.0004 inches less than conventional strippers.

Figure 5A:
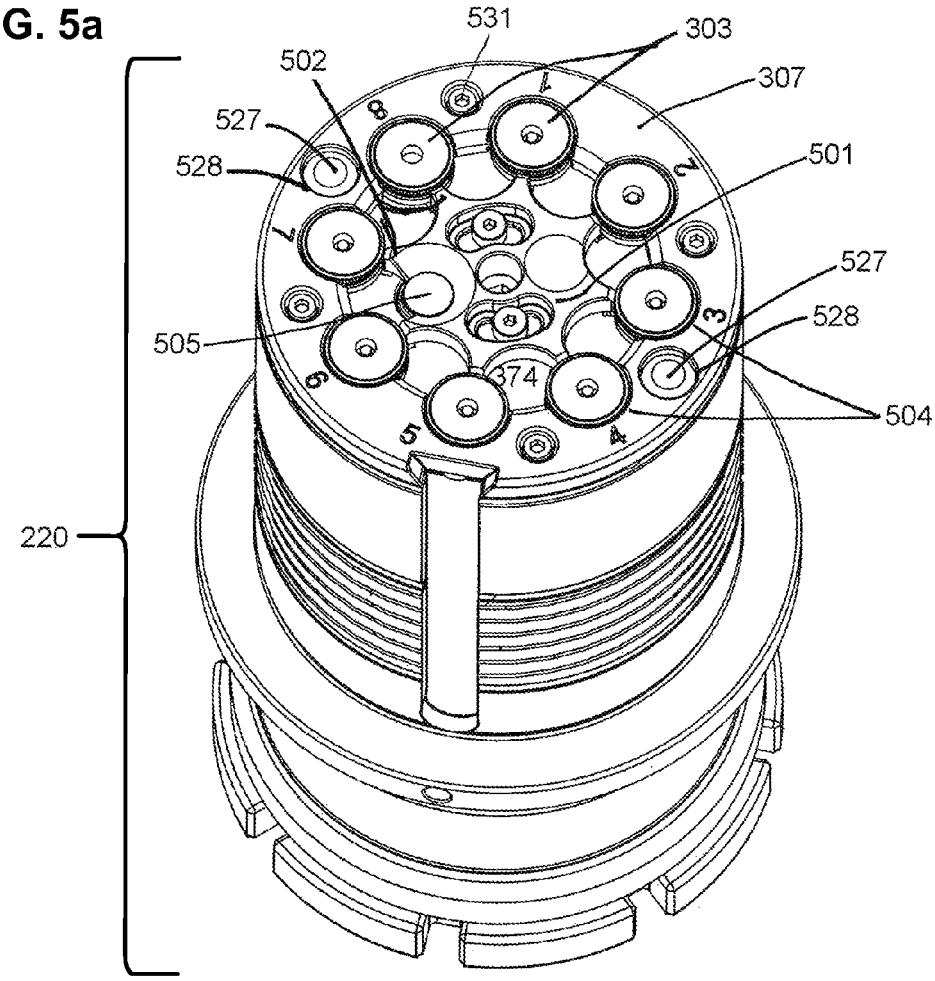
FIG. 5*a* is a pictorial view of the bottom (workpiece-facing) surface of an eight punch multi-tool showing one embodiment of a stripper and stripper retention arrangement.
Figure 5B:
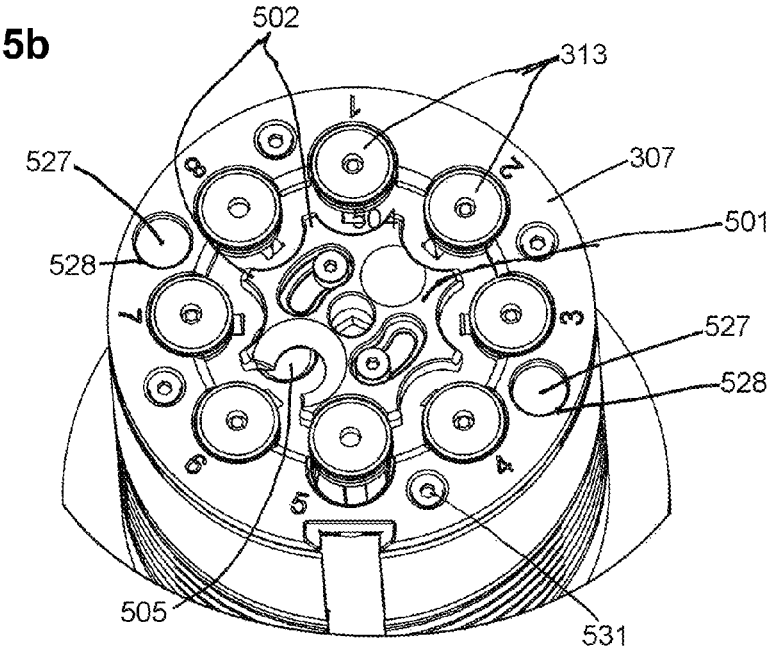
FIG. 5*b* depicts the multi-tool of FIG. 5*a* in a state allowing removal and replacement of strippers.
Figure 5C:
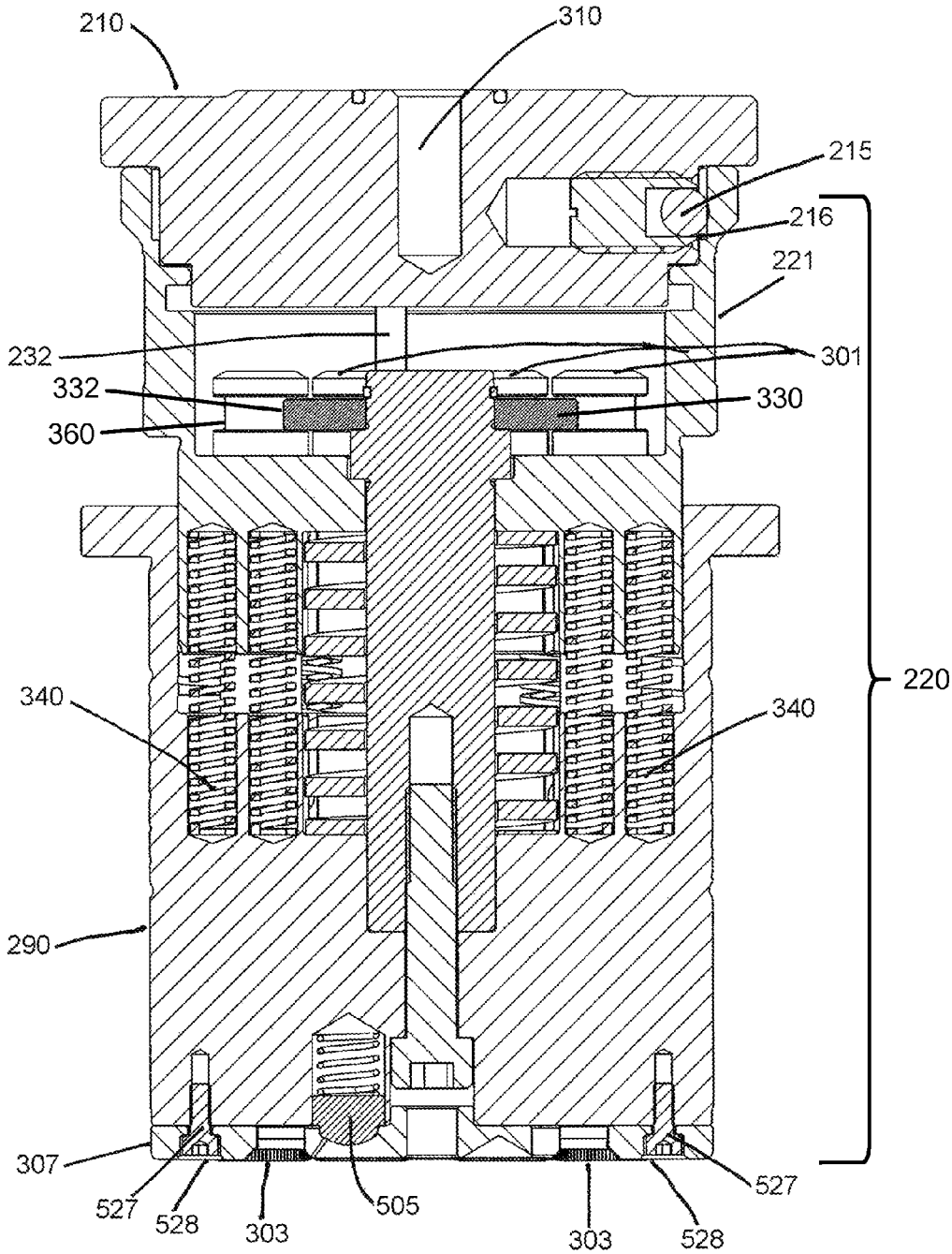
FIG. 5*c* is a cross-sectional view of the multi-tool of FIGS. 5*a*-5*b* showing retention features of the stripper and stripper retention arrangement of FIGS. 5*a*-5*b*.

In one embodiment, with reference now to FIGS. 5*a*, 5*b* and 5*c*, strippers 303 may be held in place by a precision stripper retainer 307. Each stripper 303 may be positioned in place by a precision pocket 504 machined into the periphery of the retainer 307 and a cooperating, rotatable cam/lock plate 501 located in a central position within the plane of retainer 307. Each precision pocket 504 may be cut into the retainer 307 in precise dimensions so as to fit precisions diameter of the strippers 303. Further, each precision pocket 504 may be ribbed, grooved, or otherwise machined (reference numeral 366) around its perimeter so as to engage a like feature (reference numeral 367) around the perimeter of a stripper 303. The strippers 303 may be positioned and held within the precision pockets 504 by means of the cam/lock plate 501, which pushes each of the strippers and its precision diameter into the precision pockets 504. The rotatable cam/lock plate 504 may be generally round in shape, but having tabs 502 (equal in number to strippers it controls) which extend to contact the interior-most part of the stripper 303 (the part closest to the tool's center axis) to which it is adjacent. The tips of the cam/lock plate 501 are precision machined and provide a camming action that positions each stripper precisely into its corresponding pocket. This positioning also ensures adequate interference between the circumferential ribs or grooves of the strippers 303 and corresponding ribs or projections in the pockets, to prevent vertical movement with either punching or retracting motion of a punch.

With particular reference to FIG. 5*a*, eight strippers 303 are depicted as being precisely held in place within eight respective pockets 504 of the stripper retainer 307. The rotatable lock plate 501 is depicted located centrally and generally within the perimeter defined by the strippers 303. The rotatable lock plate 501 is further depicted as being rotated to a position such that each tab 502 is in contact with the interior-most point on the perimeter of the respective stripper 303 to which it is adjacent, thus driving and holding the stripper 303 within the pocket 504. The lock plate 501 may be held in position (i.e., prevented from rotating) by a depressible button 505 which protrudes from the surface of the stripper retainer 307 and contacts the lock plate 501 between tabs 502 so as to prevent any rotation, and thereby keep the tabs 502 aligned against the strippers 303.

With reference now to FIG. 5*b*, the rotatable lock plate 501 and tabs 502 may be rotated out of contact with the strippers 303 so as to allow interchangeability of the strippers, for example, when corresponding punches are changed out. In order to rotate the stripper plate 501, the button 505 may be depressed, bringing it out of contact with the lock plate 501, and thus allowing the lock plate 501 to rotate to a position wherein the tabs 502 are positioned between and not in contact with the strippers 303. The strippers 303 may then be freely removed, after the punches 302/punch drivers 301 are removed, without the need for tools or other implements. After the strippers 303 have been interchanged, the lock plate 501 may be rotated back so that the tabs 502 contact the interior-most point of the strippers 303, thus causing the depressible button 505 to re-extend outwardly so as to be in contact with the lock plate 501 between tabs 502, thus restraining it from rotating. As can be seen, the lock plate 501 rotates about a center axis of the punch assembly between a release state in which the strippers 303 may be removed from interlock with the stripper retainer 307 and a locking state in which the precision ground cam surfaces cams each of the two or more removable strippers 305 into interlock with a corresponding precision pocket in the stripper retainer 307.

Figure 6A:
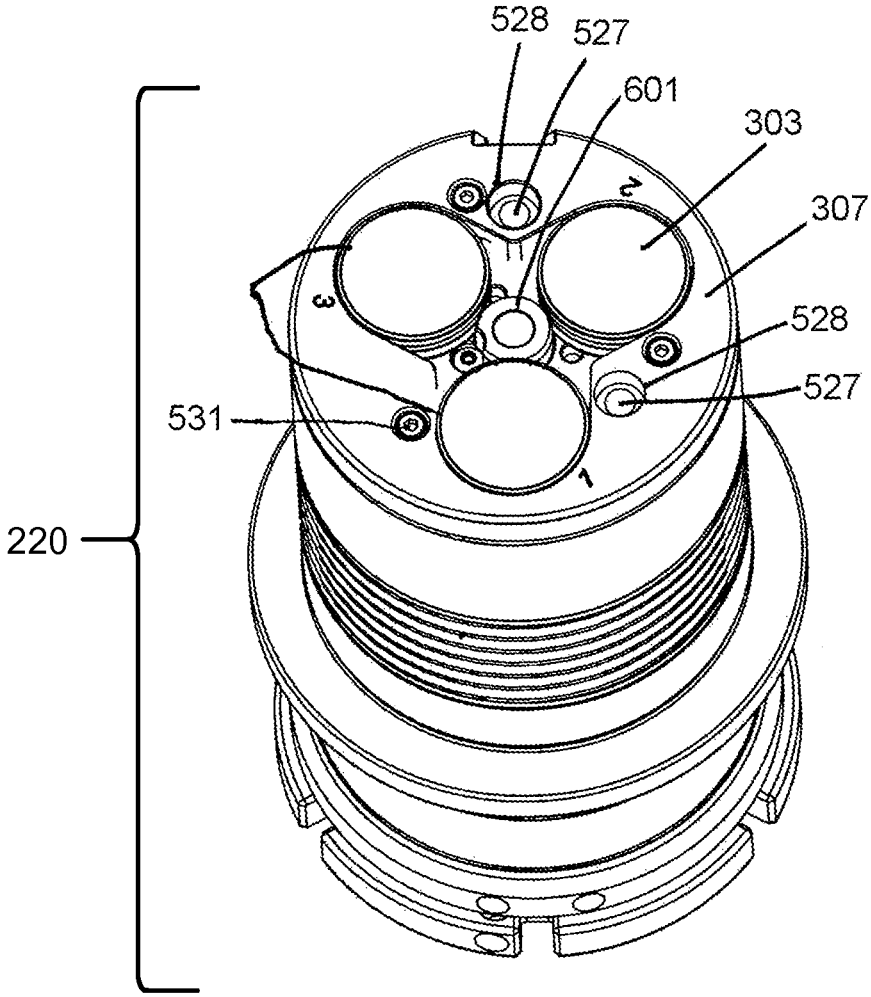
FIG. 6*a* is pictorial view of the bottom (workpiece-facing) surface of a three-punch multi-tool showing another embodiment of a stripper and stripper retention arrangement, having a retractable button camming component.
Figure 6B:
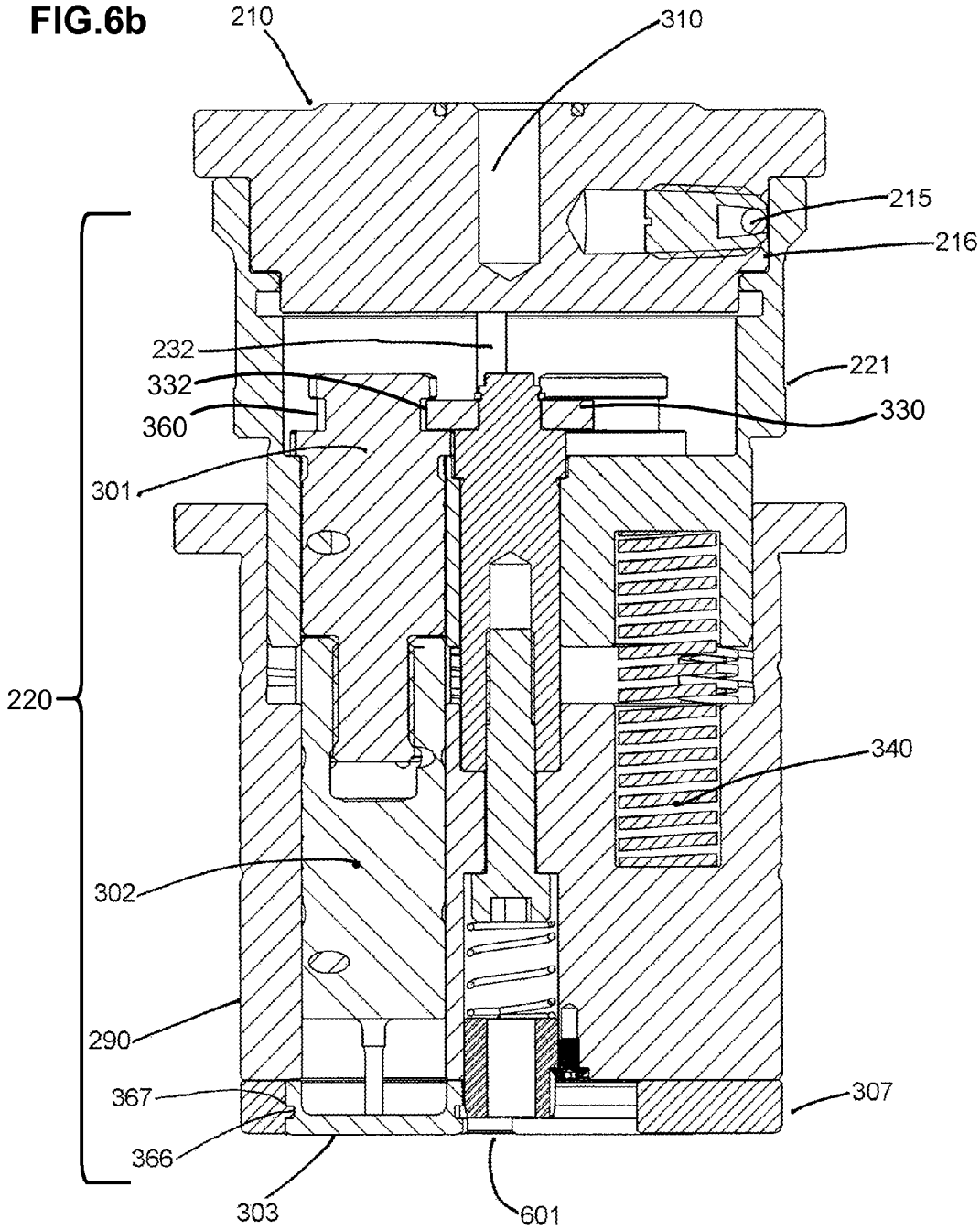
FIG. 6*b* is a cross-sectional view of the three-punch multi-tool showing the embodiment of a stripper and stripper retention arrangement of FIG. 6*a*.

In another embodiment, with reference now to FIG. 6, strippers 303 may be held in place by a precision retainer 307. Each stripper 303 may be positioned in place by a precision pocket 604 machined into the periphery of the retainer 307 and a depressible spring-loaded precision button 601 located generally centrally within the retainer 307. Further, each precision pocket 604 may be grooved, ribbed, or otherwise machined around its perimeter (reference numeral 366) so as to engage a like feature (reference numeral 377) around the perimeter of a stripper 303. The strippers 303 may be held within the precision pockets 604 by means of the precision button 601. The button 601 may be generally round in shape, and of a size so that the perimeter makes precise contact with the interior-most part of the stripper 303 to which it is adjacent.

With continued reference to FIG. 6, three strippers 303 are depicted as being precisely held in place within three respective pockets 604 of the stripper retainer 307. The depressible button 601 is depicted located centrally and generally within the perimeter defined by the strippers 303. The button 601 is further depicted as being extended outwardly such that as the button fully travels from its recessed position to its extended position, its perimeter is in contact with the interior-most point on the perimeter of the respective stripper 303 to which it is adjacent. The curved, precision surface, cams the strippers into precision pockets 604, thus also ensuring interference between the circumferential ribs or grooves of the strippers 303 and corresponding ribs, grooves, or projections in the pockets 604, to prevent vertical movement with either punching or retracting motion of a punch and to hold the stripper 303 precisely within the pocket 604.

To allow interchangeability of the strippers, for example, when corresponding punches are changed out, the depressible button may be depressed so as to move inwardly into the punch guide 290, and thus coming out of contact with the strippers 303, allowing the strippers 303 to be freely removed without the use of tools or other implements. After the strippers 303 have been interchanged, the button 601 may be re-extended so that it comes into contact again with the interior-most point of the strippers 303, thus holding them precisely in place.

In some embodiments of the presently disclosed multi-tool, one or more precision alignment pins 527 may be provided on the undersurface (workpiece-facing side) of the punch carrier assembly 220. The alignment pins 527 may be designed and positioned so as to engage corresponding holes 528 on a stripper retainer 307, for example, as depicted in FIGS. 5*a-c* and 6*a*. When a stripper retainer 307 is placed in position on the undersurface of the punch carrier assembly 220, the stripper retainer 307 may be oriented so that the holes 528 align with the alignment pins 527. The stripper retainer 307 may then be caused to be abutted with the undersurface of the punch carrier assembly 220, thus causing the alignment pins 527 to engage with the corresponding holes 528. This engagement may cause the stripper retainer 307 to be securely engaged or affixed to the punch carrier assembly 220 in an orientation suitable for normal operation of the multi-tool 110. In some embodiments, one or more screws 531 may be provided to further securably engage the stripper retainer 307 to the punch carrier assembly 220.

As depicted in FIG. 5*a-b* and 6*a*, the alignment pins 527 of the punch carrier assembly 220 are engaged within the holes 528 of the stripper retainer 307, such that each respective stripper 303 position (eight of which are shown in FIGS. 5*a-b*, and three of which are shown in FIG. 6*a*) is aligned with a corresponding punch 302 position on the punch carrier assembly 220. Further, screws 531 are depicted fastening the stripper retainer 307 to the punch carrier assembly 220. In this manner, the stripper retainer 307 may be held securely and precisely in place relative to the punch carrier assembly 220 for operation of the multi-tool 110.

Providing pins 527 on the punch carrier assembly 220 and corresponding holes 528 on a stripper retainer 307 may allow for ease of interchangeability or replacement of the stripper retainer 307. For example, if a stripper retainer 307 is misused or otherwise becomes damaged, it may need to be replaced. Alternatively, an operator may wish to change between a standard stripper retainer known in the art and a fully guided stripper retainer as has been disclosed herein. In order to change out a stripper retainer, an operator need simply remove the screws 531, disengage the stripper retainer desired to be replaced, align the holes 528 on the new stripper retainer 307 with the pins 527 of the punch carrier assembly 220, and thereafter replace the screws 531. In existing multi-tools, a similar replacement may require the operator to completely replace the punch guide 290, which is both expensive and time consuming.

Figure 7A:
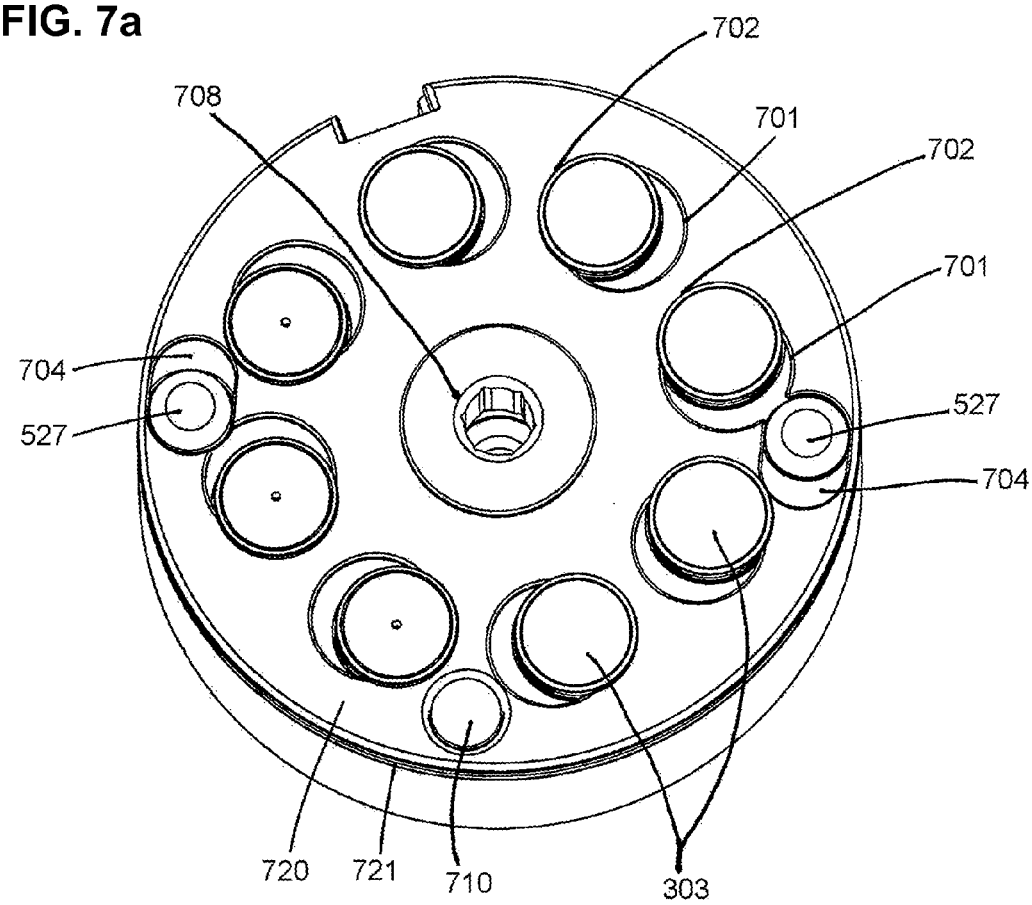
FIGS. 7*a* and 7*b* are pictorial and partial cross-sectional views, respectively, of the bottom (workpiece-facing) surface of an eight-punch multi-tool showing another embodiment of a stripper and stripper retention arrangement.
Figure 7B:
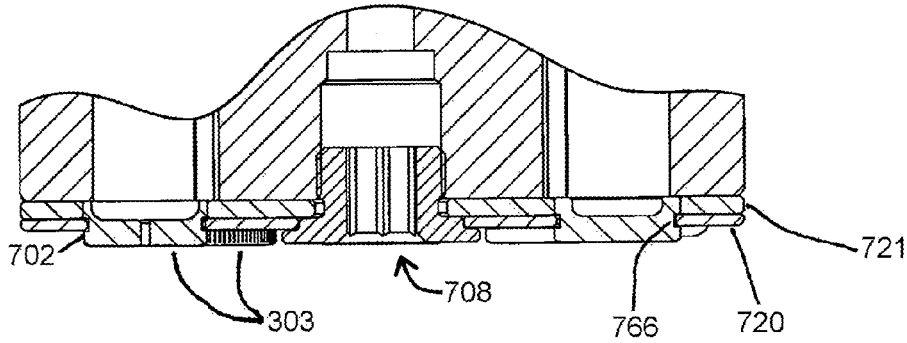

In still further embodiments, with reference now to FIGS. 7*a* and 7*b*, strippers 303 may be held vertically in place by a precision stripper retainer 720 and positionally located with precision machined and located pockets in a stripper positioning plate 721. Each stripper 303 may be securely held vertically in place by means of a smaller hole 702 in retainer 720, which may be designed to contact or abut half of the circumference of a stripper 303. The smaller hole 702 may be formed adjacent a larger hole 701, such that the smaller hole 702/ larger hole 701 combination forms a single cut-out of the surface of the stripper retainer 720. The cut-out is thus formed from half of the outer perimeter of the smaller hole 702, and half of the outer perimeter of the larger hole 701. The perimeter of the smaller hole 702 may be shaped, i.e., has a thickness, so as to fit a corresponding ribbed or grooved feature around the perimeter of a stripper 303 (reference numeral 766). The circumference of the larger hole 701 may be larger than that of a stripper 303, such that when a stripper 303 is within the perimeter of the larger hole 701, it may be removed from the stripper retainer 720 and stripper positioning plate 721.

The stripper retainer 720 as depicted in FIG. 7*a* may be alternatingly rotated about its central axis defined by means of a center hub screw 708. The stripper retainer 720 may be rotated between a position (state) wherein the stripper 303 is within the perimeter of the smaller hole 702 (and thus held securely and precisely in place for operation of the multi-tool) and a position (state) wherein the stripper 303 is within the perimeter of the larger hole 701 (and thus able to be removed by hand). As previously mentioned, the stripper may be held positionally in place by precision holes in the stripper positioning plate 721. The amount of rotation may be limited (so as to correspond with the stripper 303 being within the perimeter of either the smaller hole 702 or the larger hole 701) by one or more precision pins 527 located on the undersurface of the punch carrier assembly 220. The pins may be aligned within a channel 704 of the stripper retainer 720. When the stripper retainer 720 is rotated such that the pin 527 is at a first end of the channel 704, a stripper 303 is thereby positioned within the perimeter of the smaller hole 702, and when the stripper retainer 307 is rotated such that the pin 527 is at a second end of the channel 704, the stripper 303 is thereby positioned within the perimeter of the larger hole 701. In some embodiments, a depressible, spring mounted button 710 may further be provided to as to lock the rotation of the stripper retainer in a position such that the pins 527 are at the first end of the channel 704, thereby locking the strippers 303 within the perimeter of the smaller hole 702 for operation of the multi-tool. Depressing the button may allow the stripper retainer 307 to be rotated such that the pins 527 are at the second end of the channel 704, thereby allowing the strippers 303 to be removed from the stripper retainer 720.

As shown in FIG. 7*a*, the stripper retainer 720 is depicted as being rotated to a position such that the eight strippers 303 are securely engaged within the perimeter of the smaller holes 702 and within the bored holes of the stripper positioning plate 721. Again, only half of the perimeter of the strippers 303 is engaged with the perimeter of the smaller holes 702. A portion of the larger hole 701 (the portion not combined with the smaller hole 702) is depicted as vacant. As previously discussed, in this position, the pins 527 (two shown in FIG. 7*a*) are at a first end of the channels 704, and the depressible button 710 is in an up position (not depressed) so as to prevent the stripper retainer 720 from rotating during operation of the multi-tool. In order to remove the strippers 303 from the stripper retainer, an operator may depress the button 710, rotate the stripper retainer 720 such that the pins 527 are at the second end of the channels 704 (shown in FIG. 7*a* as being vacant), thereby positioning the strippers 303 within the perimeter of the larger holes 701 (shown in FIG. 7*a* as being vacant) and removing engagement of the groove 766, and then remove the strippers 303 from within the precision bored holes of the stripper positioning plate 721 by hand.

In a further alternative embodiment, an integrated, replaceable stripper plate may be provided in place of a stripper retainer with separate strippers. Such a stripper plate is one piece and may have precision holes thereon in shapes corresponding to the shape of the tips of the punches associated therewith, in place of replaceable strippers as depicted in the figures of this disclosure. The stripper plate may be retained on the bottom of the punch carrier assembly by screws similar to those holding retainer 307 in FIG. 6*a*. One benefit of such an integrated stripper plate is that it may be made from a somewhat resilient material, or non-metallic material (softer than typical tool materials) which may reduce wear on the punch tips and also may reduce marking on thinner, softer workpieces. These materials may include, for example, urethane, acrylonitrile-butadiene rubber (NBR) or other high modulus elastomers, polyetheretherketone (Peek), polyphthalamide (PPA or Amodel), polyoxymethylene (POM or Delrin), polyamide-imide (PAI or Torlon), or other engineering polymers, ultra-high molecular weight polyethylene (UHMW), polytetrafluoroethylene (PTFE), or other wear resistant plastics.

Lubrication and Venting

With reference again to FIGS. 3*a* and 3*c*, lubrication ducts may be provided within all of the moving parts of the multi-tool 110. For example, lubrication ducts 310 are depicted as interconnecting within the striker body 210, the ram 214, the punch drivers 301, and the punches 302. Holes within the punch drivers 301 and the punches 302 may allow lubrication to enter the interior of the punch carrier assembly 220 so as to lubricate the punches during motion. Sufficient lubrication may allow for smooth operation of the punch press and multi-tool.

With reference to FIGS. 2, 3*c*, and 3*d*, one or more venting paths 370 may be provided at the interface between the stripper retainer 307 and the punch carrier assembly 220. In some embodiments, the number of venting paths provided may be equal to the number of punch positions of the multi-tool 110. The venting paths may be machined into the underside (lower face) of the punch carrier assembly 220 in any shape. In some embodiments, the venting paths may formed with radially extending channels that are in cross-section half-moon shaped. The stripper assembly attached to the lower face of the punch guide 290 cooperates to close the open side of the channels to form one or more venting paths or tunnels. The venting paths 370 connect the internal chamber in which a punch 302 moves with the exterior, specifically, as seen in FIGS. 3*c*, 3*d* the punch guide 290 includes one or more venting channels on a lower face of the punch guide 290, with each of the one or more channels connecting an interior portion of the punch carrier assembly 220 in which the punch reciprocal motion occurs with an exterior circumference of the punch guide 290. During punch retraction, reduced air pressure (vacuum) within the multi-tool 110 may cause slugs or debris from the punched workpiece to be pulled upwardly toward the multi-tool, rather than falling downwardly into the die holes 314 of the dies 304 as is desirable. Providing venting to the moving punches 302 may help to prevent air pressure changes (vacuum formation) that would prevent the slugs from falling properly as stripping occurs.

Although the present disclosure has been described with reference to various embodiments, persons skilled in the art will recognize that changes may be made in form and detail without departing from the spirit and scope of the invention.

What is claimed is:

1. A multiple punch and die assembly adapted to be placed in a punch press having a punch ram for imparting movement to a selected punch assembly for carrying out a punching or forming operation comprising:

a punch assembly for holding a plurality of selectively operable punches mounted for independent movement in the punch assembly so as to selectively engage a workpiece, said punch assembly having a punch carrier for reciprocal motion within a punch guide;

a striker body engaging the punch carrier, said striker body being selectively, toollessly connectable to the punch carrier by a pair of tabs located on a lower circumference of the striker body, said pair of tabs located on a lower circumference of the striker body with a radial separation other than 180 degrees;

a circumferential lip in the punch carrier for receiving the pair of tabs and having corresponding radially separated reliefs for allowing the pair of tabs to pass the circumferential lip, the engagement of the pair of tabs by the circumferential lip locking the striker body to the punch carrier while permitting relative rotation of the striker body and punch carrier to select a punch for engagement by the striker; and detent means for releasably positioning the striker body in one of a plurality of operating positions, at which a punch is positioned for being struck selectively by the ram via the striker body such that one punch is driven to an operating position when at least one other punch is in inactive.

2. The assembly of claim 1 wherein the detent means comprises a circumferentially spaced set of recesses in the punch carrier and a resiliently mounted detent projection on striker body for mating with the recesses.

3. The assembly of claim 2 wherein the resiliently mounted detent projection comprises a ball plunger.

4. The assembly of claim 3 wherein the recesses comprise arcuate recesses for receiving the ball plunger.

5. The assembly of claim 4 wherein the ball plunger comprises a spring applying a force to the recesses that can be overcome by typical operator hand strength but not by typical multi-tool indexing forces.

6. A method for assembling a multiple punch and die assembly according to claim 1, as adapted to be placed in a punch press having a punch ram for imparting movement to a selected punch assembly for carrying out a punching or forming operation, the method comprising:

providing the punch assembly for holding a plurality of selectively operable punches, said punch assembly having a punch carrier for reciprocal motion within a punch guide;

mounting one or more of the plurality of selectively operable punches within the punch assembly for selective, independent movement in the punch assembly so as to selectively engage the workpiece;

attaching the striker body to the punch carrier, said striker body being selectively positionable by relative rotation of the striker body and punch carrier to select a punch for engagement by the striker, by positioning the striker body in one of a plurality of operating positions, at which a punch is positioned for being struck selectively by the ram via the striker body such that one punch is driven to an operating position when at least one other punch is in inactive;

mounting on the punch guide lower end a stripper retainer configured to hold and precision position two or more removable strippers, said stripper retainer having a cam structure for urging removable strippers into a corresponding precision pocket in the stripper retainer that interlocks with the removable strippers to prevent their movement along the axis of punch motion and for releasing the removable strippers from the pockets; and precision positioning two or more removable strippers in the stripper retainer by camming the cam structure such that the removable strippers are interlocked in a corresponding precision pocket within the stripper retainer.

7. The method of claim 6 wherein the step of mounting a stripper retainer comprises mounting a stripper retainer in a first state in which the strippers are fully insertable and removable and rotating the stripper retainer to a second state in which the strippers are locked against movement along the axis of punch motion.

8. The method of claim 6 wherein the step of precision positioning comprises depressing a push button to permit insertion of each stripper into a loose fit with a corresponding precision pocket and removing the push button from its depressed position to an extended position in which a precision diameter of the push button cams each stripper into its corresponding precision pocket while locking it against the axis of punch motion.

9. The method of claim 6 further comprising adjusting a stripping force applied to the punch carrier either by selectively removing in a generally symmetrical manner relative to a central axis of the punch guide two or more springs compressed when the striker body drives a punch into a workpiece or by replacing in a generally symmetrical force pattern relative to a central axis of the punch guide two or more such springs with springs of a selected different spring constant.

10. A multiple punch and die assembly adapted to be placed in a punch press having a punch ram for imparting movement to a selected punch assembly for carrying out a punching or forming operation comprising:

a punch assembly for holding a plurality of selectively operable punches mounted for independent movement in the punch assembly so as to selectively engage a workpiece, said punch assembly having a punch carrier for reciprocal motion within a punch guide;

a striker body engaging the punch carrier, said striker body being selectively positionable by relative rotation of the striker body and punch carrier to select a punch for engagement by the striker, by positioning the striker body in one of a plurality of operating positions, at which a punch is positioned for being struck selectively by the ram via the striker body such that one punch is driven to an operating position when at least one other punch is in inactive; and a punch lock plate mounted in the punch carrier and having a circumferential edge for engaging a notch in a driver portion of each punch, said edge including a recess that releases a single punch from engagement when the recess is angularly aligned with such single punch, said punch lock plate being operably engaged to rotate with the striker body.

11. The assembly of claim 10 wherein the striker body carries a pin that engages the punch lock plate to carry rotational motion of striker body to the punch lock plate so as to position the striker to engage a punch position of the punch lock plate recess to release such punch.

12. The assembly of claim 10 wherein the punch lock plate recess comprises a flat edge of a circular plate.

13. The assembly of claim 10 wherein the punch carrier has two or more indicators each corresponding to a punch operating position and the striker body has a window for viewing an indicator of one active punch operating position.

14. A method for assembling a multiple punch and die assembly according to claim 10, as adapted to be placed in a punch press having a punch ram for imparting movement to a selected punch assembly for carrying out a punching or forming operation, said punch assembly holding a plurality of selectively operable punches and having a punch carrier for reciprocal motion within a punch guide, the method comprising:

providing at least one punch comprising a punch driver portion adjustably connected to a corresponding punch with a punch tip by means of threads on the male-female mating ends of the punch driver and the punch, said punch driver have a length adjustment reference edge and each of the punch driver and the punch having an alignment key to guide insertion into the punch assembly;

providing on the exterior of the punch guide a flange and a length adjustment reference mark having a distance therebetween equal to the distance between (a) the length adjustment reference edge of a punch driver when a properly adjusted punch rests in a non-operating position and (b) the bottom surface of a corresponding stripper for the punch, less a small stripper lead, to define a reference length;

resting the punch working tip on the flange and by relative rotation of the punch driver and punch, adjusting the at least one punch driver adjustably connected to a corresponding punch to have length corresponding to the reference length between the punch tip and the punch driver's length adjustment reference edge; and further adjusting the at least one punch driver adjustably connected to a corresponding punch by relative rotation of less than a full turn to bring into alignment the respective keys of the punch driver and punch.

15. The method of claim 14 wherein the step of further adjusting comprises performing a relative rotation that brings into alignment the respective keys of the punch driver and punch with a rotation direction that uses a shortest arc of relative rotation to achieve such alignment.

16. The method of claim 14 wherein the length adjustment reference mark is a machined circumferential edge on the punch guide.

17. A multiple punch and die assembly adapted to be placed in a punch press having a punch ram for imparting movement to a selected punch assembly for carrying out a punching or forming operation comprising:

a punch assembly for holding a plurality of selectively operable punches mounted for independent movement in the punch assembly so as to selectively engage a workpiece, said punch assembly having a punch carrier for reciprocal motion within a punch guide;

a striker body engaging the punch carrier, said striker body being selectively positionable by relative rotation of the striker body and punch carrier to select a punch for engagement by the striker, by positioning the striker body in one of a plurality of operating position, at which a punch is positioned for being struck selectively by the ram via the striker body such that one punch is driven to an operating position when at least one other punch is in inactive; and a stripper retainer mounted on the punch guide lower end for holding and precision positioning of two or more removable strippers, said punch guide having a cam structure for urging each of the removable strippers into a corresponding precision pocket in the stripper retainer that interlocks with the stripper to prevent stripper movement along the axis of punch motion and for releasing removable strippers from the pockets.

18. The assembly of claim 17 wherein the cam structure comprises a center push button with a release state in which the button is recessed from a lower surface of the stripper retainer and each stripper is removable and a locking state in which the button extends toward the lower surface of the stripper retainer and a precision ground outer diameter of the push button cams each of the two or more removable strippers into interlock with a corresponding precision pocket in the stripper retainer.

19. The assembly of claim 17 wherein the cam structure comprises:

a center lock plate with a plurality of release pockets and each with an adjacent positioning cam, each positioning cam having a precision ground cam surface; and means for mounting the center lock plate for rotation about a center axis of the punch assembly between a release state in which the strippers may be removed from interlock with the stripper retainer and a locking state in which the precision ground cam surfaces cams each of the two or more removable strippers into interlock with a corresponding precision pocket in the stripper retainer.

20. The assembly of claim 19, wherein the center lock plate is locked into an angular position corresponding to the locking state by a push button with a release state in which the button is recessed from interference with the center lock plate and a locking state in which the button extends toward the lower surface of the center lock plate.

21. The assembly of claim 17 wherein the exterior of each stripper received in a precision pocket comprises precision machined surface mating with the precision pocket.

22. A multiple punch and die assembly adapted to be placed in a punch press having a punch ram for imparting movement to a selected punch assembly for carrying out a punching or forming operation comprising:

a punch assembly for holding a plurality of selectively operable punches mounted for independent movement in the punch assembly so as to selectively engage a workpiece, said punch assembly having a punch carrier for reciprocal motion within a punch guide;

a striker body engaging the punch carrier, said striker body being selectively positionable by relative rotation of the striker body and punch carrier to select a punch for engagement by the striker, by positioning the striker body in one of a plurality of operating position, at which a punch is positioned for being struck selectively by the ram via the striker body such that one punch is driven to an operating position when at least one other punch is in inactive; and a stripper retainer mounted on the punch guide lower end for holding and precision positioning of two or more removable strippers, said retainer being mounted for rotation about a center axis of the punch assembly between a release state in which the strippers may be removed from interlock with the stripper retainer and a locking state in which a corresponding precision ground pocket captures each of the two or more removable strippers by interlock with such precision pocket in the stripper retainer;

wherein the retainer is locked into an angular position corresponding to the locking state by a push button with a release state in which the button is recessed from interference with the retainer and a locking state in which the button extends toward the lower surface of the retainer.

23. A multiple punch and die assembly adapted to be placed in a punch press having a punch ram for imparting movement to a selected punch assembly for carrying out a punching or forming operation comprising:

a punch assembly for holding a plurality of selectively operable punches mounted for independent movement in the punch assembly so as to selectively engage a workpiece, said punch assembly having a punch carrier for reciprocal motion within a punch guide;

a striker body engaging the punch carrier, said striker body being selectively positionable by relative rotation of the striker body and punch carrier to select a punch for engagement by the striker, by positioning the striker body in one of a plurality of operating position, at which a punch is positioned for being struck selectively by the ram via the striker body such that one punch is driven to an operating position when at least one other punch is in inactive; and wherein the punch guide includes one or more venting channels on a lower face of the punch guide, each of the one or more channels connecting an interior portion of the punch carrier, in which the punch reciprocal motion occurs, to an exterior circumference of the punch guide.

24. The assembly of claim 23, wherein the one or more venting channels are substantially half-moon shaped.

25. The assembly of claim 23, wherein the number of venting channels is equal to the number of selectively operable punches that the assembly is configured to hold.

26. The assembly of claim 23, wherein a stripper plate attached to the lower face of the punch guide cooperates to close the one or more channels to form one or more vent tunnels.

27. The assembly of claim 26, wherein the stripper plate comprises an integrated stripper plate made from a non-metallic material selected from the group consisting of urethane, acrylonitrile-butadiene rubber or other high modulus elastomers, polyetheretherketone, polyphthalamide, polyoxymethylene, polyamide-imide, or other engineering polymers, ultra-high molecular weight polyethylene, polytetrafluoroethylene, or other wear resistant plastics.

* * * * *